US011511977B2

(12) United States Patent
Eto

(10) Patent No.: US 11,511,977 B2
(45) Date of Patent: Nov. 29, 2022

(54) CRANE

(71) Applicant: KOBELCO CONSTRUCTION MACHINERY CO., LTD., Hiroshima (JP)

(72) Inventor: Takao Eto, Hyogo (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 38 days.

(21) Appl. No.: 17/302,930

(22) Filed: May 17, 2021

(65) Prior Publication Data

US 2021/0387835 A1 Dec. 16, 2021

(30) Foreign Application Priority Data

Jun. 15, 2020 (JP) ..... JP2020-102870

(51) Int. Cl.
*B66C 23/76* (2006.01)
*B66C 23/18* (2006.01)
(Continued)

(52) U.S. Cl.
CPC ..... *B66C 23/76* (2013.01); *B66C 13/18* (2013.01); *B66C 23/42* (2013.01); *B66C 2700/0371* (2013.01)

(58) Field of Classification Search
CPC ..... B66C 23/74; B66C 23/76
See application file for complete search history.

(56) References Cited

U.S. PATENT DOCUMENTS 4,349,115 A * 9/1982 Lampson ..... B66C 23/76 212/178
2009/0272708 A1* 11/2009 Zollondz ..... B66C 23/74 212/196

(Continued)

FOREIGN PATENT DOCUMENTS

DE 10 2016 113 359 A1 1/2017
JP 09-272457 A 10/1997
JP 2013-100161 A 5/2013

OTHER PUBLICATIONS

Extended European Search Report dated Nov. 19, 2021 in European Patent Application No. 21175204.3, 10 pages.

*Primary Examiner* — Michael R Mansen
*Assistant Examiner* — Juan J Campos, Jr.
(74) *Attorney, Agent, or Firm* — Oblon, McClelland, Maier & Neustadt, L.L.P.

(57) ABSTRACT

To provide a crane capable of stably traveling a transporter capable of supporting a counterweight in cooperation with slewing of an upper slewing body. The crane has a connecting body connecting the self-propelled transporter and the upper traveling body, a transporter angle detecting unit, and a steering angle setting unit. A transporter connecting portion of the connecting body is rotatably connected to the self-propelled transporter about a rotation center axis, and moves relative to a slewing body connecting portion whereby the relative distance between the self-propelled transporter and the upper slewing body is variable. The steering angle setting unit sets the steering angle of the wheels of the self-propelled transporter according to the transporter angle detected by the transporter angle detecting unit so that the transporter angle approaches 90 degrees.

7 Claims, 11 Drawing Sheets

(51) Int. Cl.
*B66C 13/18* (2006.01)
*B66C 23/42* (2006.01)

(56) References Cited

U.S. PATENT DOCUMENTS

| | | | | |
|---|---|---|---|---|
| 2013/0105429 | A1* | 5/2013 | Kakeya | B66C 23/74 212/279 |
| 2017/0015533 | A1* | 1/2017 | Iwazawa | B66C 13/18 |
| 2017/0022035 | A1* | 1/2017 | Iwazawa | B66C 13/20 |

* cited by examiner

CRANE

INCORPORATION BY REFERENCE

This application is based on Patent Application No. 2020-102870, filed on Jun. 15, 2020 to the Japan Patent Office, the contents of which are incorporated by reference.

BACKGROUND ART

The present invention relates to a crane that can be used with a transporter for supporting a counterweight.

Conventionally, there is known a crane having a lower traveling body capable of traveling on the ground, an upper slewing body pivotally mounted with respect to the lower traveling body, a boom mounted in a derricking manner with respect to the upper slewing body, a mast mounted on the upper slewing body and supporting the boom from behind, and a counterweight disposed behind the upper slewing body and connected to the mast via a guy-line so as to balance between the upper slewing body and the boom. In such a conventional crane, the counterweight has a function to keep the crane balanced as a weight for SHL (Super Heavy Lifting) which is provided for the crane to lift a heavy object.

Thus, when the crane is used in SHL applications, a transporter for moving the counterweight is required. Therefore, for example, a self-propelled multi-axle transporter which is a general-purpose self-propelled transporter for transporting heavy objects, or a transporter called SPMT (Self-Propelled Modular Transporter) can be used as a self-propelled transporter for counterweights.

JP-119-272457 discloses a crane having a self-propelled transporter which is disposed behind the upper slewing body and can self-propelled on the ground, a weight placed on the self-propelled transporter, and a connecting link connecting a slewing frame of the upper slewing body and the self-propelled transporter to each other, respectively. The self-propelled transporter has a plurality of wheels which can be rotated around a rotation axis extending in the vertical direction, and the direction of each wheel is independently changed (turned). Further, the self-propelled transporter is connected to a suspended pendant rope (weight guy-link) suspended from the distal end of the mast, and the weight is placed on the self-propelled transporter.

The crane described in JP-H9-272457 has a wheel turn control unit. The wheel turn control unit rotates the wheels of the transporter according to the slewing direction and the slewing angle of the upper slewing body when the upper slewing body rotates by a slewing motor provided in the crane and the self-propelled transporter travels on a circumference of a predetermined rotation radius in cooperation with the slewing of the upper slewing body to move the suspended load in the slewing direction.

In the crane as described above, if the direction of each wheel changes due to the incline of the ground or the unevenness of the road surface when the self-propelled transporter travels on a circumference centered on the slewing center axis in the ground, the self-propelled transporter tris to deviate from the circumference whereby a large load is applied to the connecting link connecting the transporter and the upper swing body, there is a problem that the connecting portion of the upper slewing body connected with the connecting link and the connecting link are easily damaged.

SUMMARY OF INVENTION

An object of the present invention is to provide a crane capable of stably traveling the transporter in cooperation with the rotation of the upper slewing body while suppressing the large load applied to the connecting body connecting the counterweight and the upper slewing body to each other.

What is provided by the present invention is a crane used with a self-propelled transporter. The self-propelled transporter includes a loading platform, a plurality of wheels disposed below the loading platform and configured to be rolled on a traveling surface and a wheel drive unit capable of respectively rolling the plurality of wheels by a predetermined traveling command signal given, and a wheel steering unit capable of steering the plurality of wheels around a steering center axis extending in the vertical direction respectively by a predetermined steering command signal given.

The crane includes a lower body, an upper slewing body, a derricking body, a mast, a counterweight, a guy-line, a connecting body, a transporter angle detecting unit, a traveling signal input unit, a steering angle setting unit, and a steering signal input unit.

The upper slewing body is mounted on the lower body so as to be slewable about a slewing center axis extending in the vertical direction.

The derricking body is rotatably attached to the upper slewing body in a derricking direction.

The mast is rotatably mounted on the upper slewing body in the derricking direction at the rear of the derricking body in the front-rear direction of the upper slewing body, to support the derricking body from the rear.

The counterweight is supported on the loading platform of the self-propelled transporter at the rear of the upper slewing body in the front-rear direction.

The guy-line connects the counterweight and the distal end of the mast to each other. The connecting body connects the rear end portion of the upper slewing body and the transporter to each other in the front-rear direction. The connecting body includes a slewing body connecting portion and a transporter connecting portion. The slewing body connecting portion is connected to the rear end portion of the upper slewing body in the front-rear direction. The transporter connecting portion is coupled to the transporter so as to be rotatable about a rotation center axis extending in the vertical direction, and is movable in the front-rear direction relatively with respect to the slewing body connecting portion in conjunction with the travel of the transporter in a direction including the front-rear direction of the transporter.

The transporter angle detecting unit is capable of detecting a transporter angle. The transporter angle is an angle formed by a line segment connecting the slewing center axis and the rotation center axis and a line segment extending from the rotation center axis in a straight driving direction of the transporter in a plan view.

The traveling signal input unit inputs the traveling command signal to the wheel drive unit in the transporter slewing operation. The transporter slewing operation is an operation in which the transporter travels on the traveling surface in the slewing direction around the slewing center axis in a state where the upper slewing body and the transporter are connected to each other by the connecting body and the rotation center axis is disposed on a circumference of a predetermined initial radius around the slewing center axis in a plan view.

The steering angle setting unit sets a steering angle of the plurality of wheels with respect to the straight driving direction to a preset initial steering angle respectively at the start of the transporter slewing operation, and sets the steering angle of the plurality of wheels in accordance with at least the transporter angle detected by the transporter angle detecting unit so that the transporter angle approaches 90 degrees during the transporter slewing operation. The initial steering angle is an angle set in accordance with the initial radius so that each of the plurality of wheels faces the inside in the radial direction.

The steering signal input unit inputs the steering command signal corresponding to the steering angle set by the steering angle setting unit.

DESCRIPTION OF EMBODIMENTS

Figure 1:
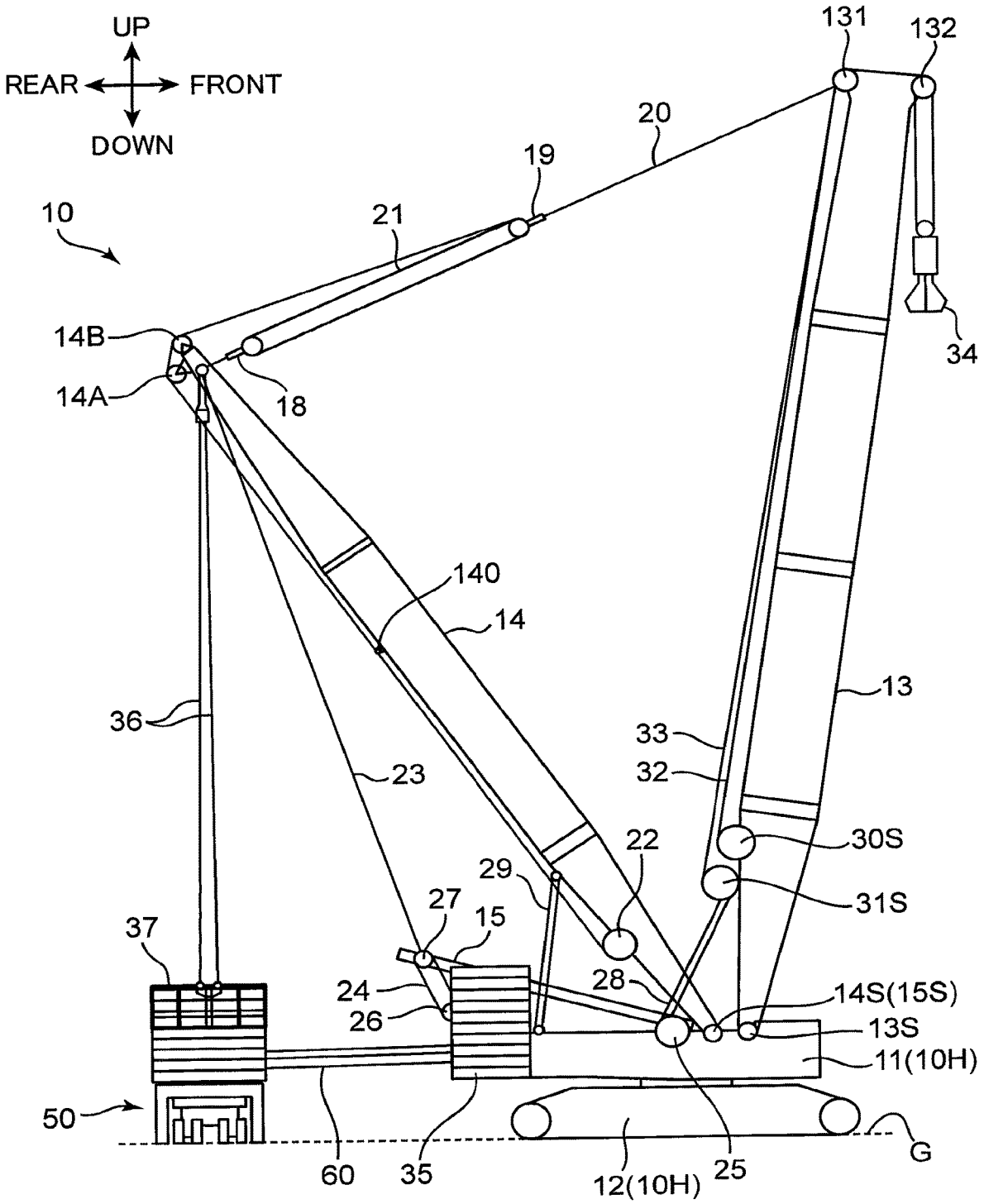
FIG. 1 is a side view of a crane according to an embodiment of the present invention.
Figure 2:
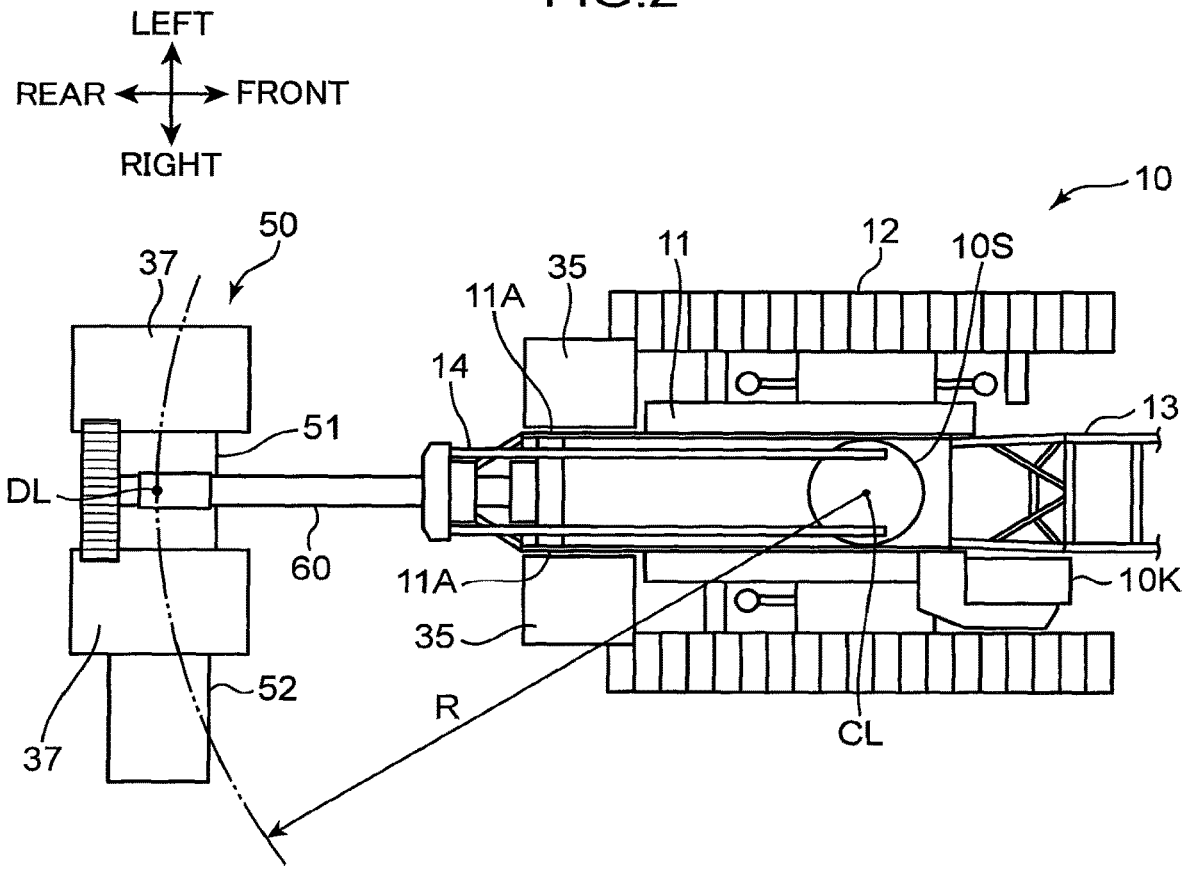
FIG. 2 is a plan view of the crane according to the embodiment of the present invention.

Hereinafter, an embodiment of the present invention will be described with reference to the drawings. FIGS. 1 and 2 are side and plan views of a crane 10 according to an embodiment of the present invention. Thereafter, the directions of "up", "down", "left", "right", "front" and "rear" are shown in each figure, but the direction is shown for convenience in order to explain the structure and assembly method of the crane 10 according to the present embodiment, it is not intended to limit the movement direction and the use mode and the like of the crane according to the present invention. Further, each direction described above shows based on an upper slewing body 11 as a reference.

The crane 10 includes a lower traveling body 12 (lower body) capable of traveling on the ground, the upper slewing body 11 which is mounted on the lower traveling body 12 to be slewable about a slewing center axis CL extending in the vertical direction, a boom 13 (derricking body) rotatably attached to the upper slewing body 11 in a derricking direction, a HL mast 14 (mast) as a boom derricking member, a box mast 15, and a cab 10K (FIG. 2). The upper slewing body 11 and the lower traveling body 12 constitute a crane body 10H of the crane 10. The cab 10K is an operation room allowing the operator (worker) to ride on.

The boom 13 shown in FIG. 1 is supported so as to be rotatable in the derricking direction on the front portion of the upper slewing body 11. The boom 13 includes a boom foot 13S. The boom foot 13S is a fulcrum portion in the rotation of the boom 13. The boom foot 13S forms a horizontal rotation axis extending in the right-left direction (lateral direction).

Further, the boom 13 has idler sheaves 131 and 132. The idler sheaves 131 and 132 are rotatably supported on the distal end portion of the boom 13.

The crane 10 further includes a pair of right and left boom back stops 28 provided on the proximal end side of the boom 13. The boom back stops 28 contacts the upper slewing body 11 when the boom 13 reaches the standing posture shown in FIG. 1. By these contacts, the boom 13 is restricted to be fanned rearward by strong wind and the like.

The HL mast 14 is rotatably supported on the upper slewing body 11 about a rotation axis parallel to the rotation axis of the boom 13 at a position on the rear side of the boom 13. That is, the HL mast 14 is rotatably mounted on the upper slewing body 11 in the derricking direction at the rear of the boom 13 in the front-rear direction of the upper slewing body 11 and supports the boom 13 from the rear. The HL mast 14 is also rotatable in the same direction as the derricking direction of the boom 13. The HL mast 14 has an HL mast foot 14S. The HL mast foot 14S serves as a fulcrum in the rotation of the HL mast 14. The HL mast foot 14S forms a rotation axis extending in the right-left direction (lateral direction). The HL mast 14 functions as a strut in the rotation of the boom 13 in a backward tilting posture extending rearward and upward obliquely from the upper slewing body 11, as shown in FIG. 1. In other embodiments, the mast of the present invention exemplified by the HL mast 14 may be made of other forms such as a box-shaped mast. The HL mast 14 further includes a mast idler sheave 140. The mast idler sheave 140 is disposed on the rear side of the longitudinal central portion of the HL mast 14.

The crane 10 further includes a pair of right and left mast back stops 29 provided on the proximal end side of the HL mast 14. The mast back stop 29 extends from the HL mast 14 of the backward inclination posture (standing posture) shown in FIG. 1 at a position rearward of the rotation axis of the HL mast 14 (HL mast foot 14S), and contacts a receiving portion (not shown) disposed on the upper slewing body 11, and prevents the HL mast 14 from falling backward by strong wind and the like.

The box mast 15 is pivotally coupled to the upper slewing body 11 at the rear side (below) of the HL mast 14. The box mast 15 has a rectangular shape in cross-sectional view. The rotation axis of the box mast 15 is parallel to the rotation axis of the boom 13 and is disposed at substantially the same position as the rotation axis of the HL mast 14. That is, the box mast 15 is also rotatable in the same direction as the derricking direction of the boom 13. The box mast 15 has a box mast foot 15S. The box mast foot 15S serves as a fulcrum in the rotation of the box mast 15. The box mast foot 15S forms a rotation axis extending in the right-left direction (lateral direction).

Further, the crane 10 includes a lower spreader 18, an upper spreader 19, a pair of right and left guy-line 20, a boom derricking rope 21, and a boom derricking winch 22.

The lower spreader 18 is supported on the distal end of the HL mast 14. The lower spreader 18 is provided with a lower sheave block (not shown), a plurality of sheaves are arranged in the width direction (right-left direction) in the lower sheave block.

The upper spreader 19 is spaced a predetermined distance ahead of the lower spreader 18. The upper spreader 19 is connected to the distal end of the boom 13 via guy-lines 20. The upper spreader 19 is provided with an upper sheave block (not shown), a plurality of sheaves is arranged in the width direction (right-left direction) in the upper sheave block.

A pair of right and left guy-lines 20 are arranged at intervals from each other in the right-left direction perpendicular to the paper surface of FIG. 1. The rear end of each guy-line 20 is connected to the upper spreader 19, and the front end of each guy-line 20 is connected to the tip of the boom 13. The guy-lines 20 include guy-links (metal plates), guy-lopes, guy-line2 (metal wires), and the like.

The boom derricking rope 21 is drawn from the boom derricking winch 22, after being hung on the sheaves 14A, 14B of the distal end portion of the HL mast 14, and is hung a plurality of times between the lower sheave block of the lower spreader 18 and the upper sheave block of the upper spreader 19. Further, the distal end portion of the boom derricking rope 21 after being hung on the lower sheave block and the upper sheave block is fixed to the distal end portion of the HL mast 14.

The boom derricking winch 22 is located on the proximal end side of the HL mast 14. The boom derricking winch 22 varies the distance between the lower sheave block of the lower spreader 18 and the upper sheave block of the upper spreader 19 by winding and unwinding the boom derricking rope 21, thereby derricking the boom 13 while rotating the boom 13 relative to the HL mast 14.

Further, the crane 10 includes a pair of right and left mast guy-links 23, a mast derricking rope 24, and a mast derricking winch 25.

The mast guy-links 23 connect the tip of the HL mast 14 and the tip of the box mast 15 to each other. This connection links the rotation of the HL mast 14 with the rotation of the box mast 15.

The mast derricking rope 24 is hung a plurality of times between a sheave block 26 including a plurality of sheaves arranged in the width direction and arranged in the upper slewing body 11, and a sheave block 27 including a plurality of sheaves arranged in the width direction and arranged at the distal end portion of the box mast 15.

The mast derricking winch 25 is disposed on the upper slewing body 11. The mast derricking winch 25 winds and unwinds the mast derricking rope 24. The winding and unwinding operations of the mast derricking rope 24 by the mast derricking winch 25 change the distance between the sheave block 27 at the distal end of the box mast 15 and the sheave block 26 at the rear end of the upper slewing body 11 whereby the box mast 15 and the HL mast 14 are integrally rotated with respect to the upper slewing body 11, and the HL mast 14 is derricking. Incidentally, the rotation of the HL mast 14 and the box mast 15 is mainly performed at the time of assembly and disassembly of the crane 10, and the positions (ground diagonals) of the HL mast 14 and the box mast 15 are substantially fixed when the crane 10 is used.

In addition to the aforementioned mast derricking winch 25 and the boom derricking winch 22, the crane 10 is mounted with the main winding winch 30S and the auxiliary winding winch 31S for hoisting and lowering the load. In the crane 10 according to the present embodiment, both the main winding winch 30S and the auxiliary winding winch 31S are mounted on the base end portion of the boom 13. The winches 30S and 31S of the crane 10 may be mounted on the upper slewing body 11.

The main winding winch 30S performs hoisting and lowering of the hoisting load by the main winding rope 32 (FIG. 1). For this main winding, the aforementioned idler sheaves 131 and 132 are rotatably provided at a distal end portion of the boom 13, and a main winding sheave block is further provided at a position adjacent to the idler sheave. The main winding sheave block includes a plurality of main winding point sheaves arranged in the width direction. The main winding rope 32 which is suspended from the main winding sheave block is connected with the main hook 34 for hanging load. Then, the main winding rope 32 drawn out from the main winding winch 30S is hung in order to the idler sheaves 131 and 132, and is stretched between the sheave of the main winding sheave block, and the sheave of the sheave block provided on the main hook 34. Therefore, when the main winding winch 30S performs winding and unwinding of the main winding rope 32, winding and lowering of the main hook 34 is performed.

Similarly, the auxiliary winding winch 31S performs hoisting and lowering of the load by the auxiliary winding rope 33. For this auxiliary winding, the same structure (not shown) as the main winding described above is provided. When the auxiliary winding winch 31S winds or unwinds the auxiliary winding rope 33, an unillustrated auxiliary hook for hoisting load connected to the distal end of the auxiliary winding rope 33 is wound or lowered.

Further, the crane 10 includes a pair of right and left counterweights 35, a pair of right and left weight guy-links 36 (guy-lines), and a pair of right and left counterweights 37.

The pair of right and left counterweights 35 is arranged at intervals in the right-left direction at the rear end of the slewing frame of the upper slewing body 11, respectively. Further, the pair of right and left counterweights 37 is disposed behind the upper slewing body 11 in the front-rear direction of the upper slewing body 11. The counterweight 35 and the counterweight 37 are weights for maintaining the balance of the crane 10.

The pair of right and left counterweights 37 is constituted by plate-shaped weights stacked vertically, and is supported by the self-propelled transporter 50. In particular, the counterweight 37 has a function of balancing the crane 10 as a weight for SHL (Super Heavy Lifting) provided for the crane 10 to lift the heavy object. The counterweight 37 is placed on the pallet 51P on the self-propelled transporter 50 (FIG. 3), and the pallet 51P is connected to the distal end portion of the HL mast 14 by a pair of right and left weight guy-links 36 (weight guy-lines). In other words, the self-propelled transporter 50 for supporting the counterweight 37 is suspended from the distal end portion of the HL mast 14 via the pair of right and left weight guy-links 36. The pair of right and left weight guy-links 36 is composed of front and rear two guy-links (ropes) respectively. Incidentally, in FIG. 1, among the right and left weight guy-links 36, only the weight guy-links 36 on the right side (front side of the paper) appears.

In this embodiment, the self-propelled transporter 50 (the self-propelled transporter) supporting the counterweight 37 is composed of a general-purpose transporter rather than a transporter dedicated to the crane 10. In another embodiment, the self-propelled transporter 50 may be a transporter dedicated to the crane 10. In this case, the self-propelled transporter 50 constitutes a part of the crane 10. Further, the crane 10 has a connecting beam 60 (connecting body) (FIG. 1). The connecting beam 60 is a member for connecting the self-propelled transporter 50 for supporting the counterweight 37 and the upper slewing body 11 to each other.

Figure 3:
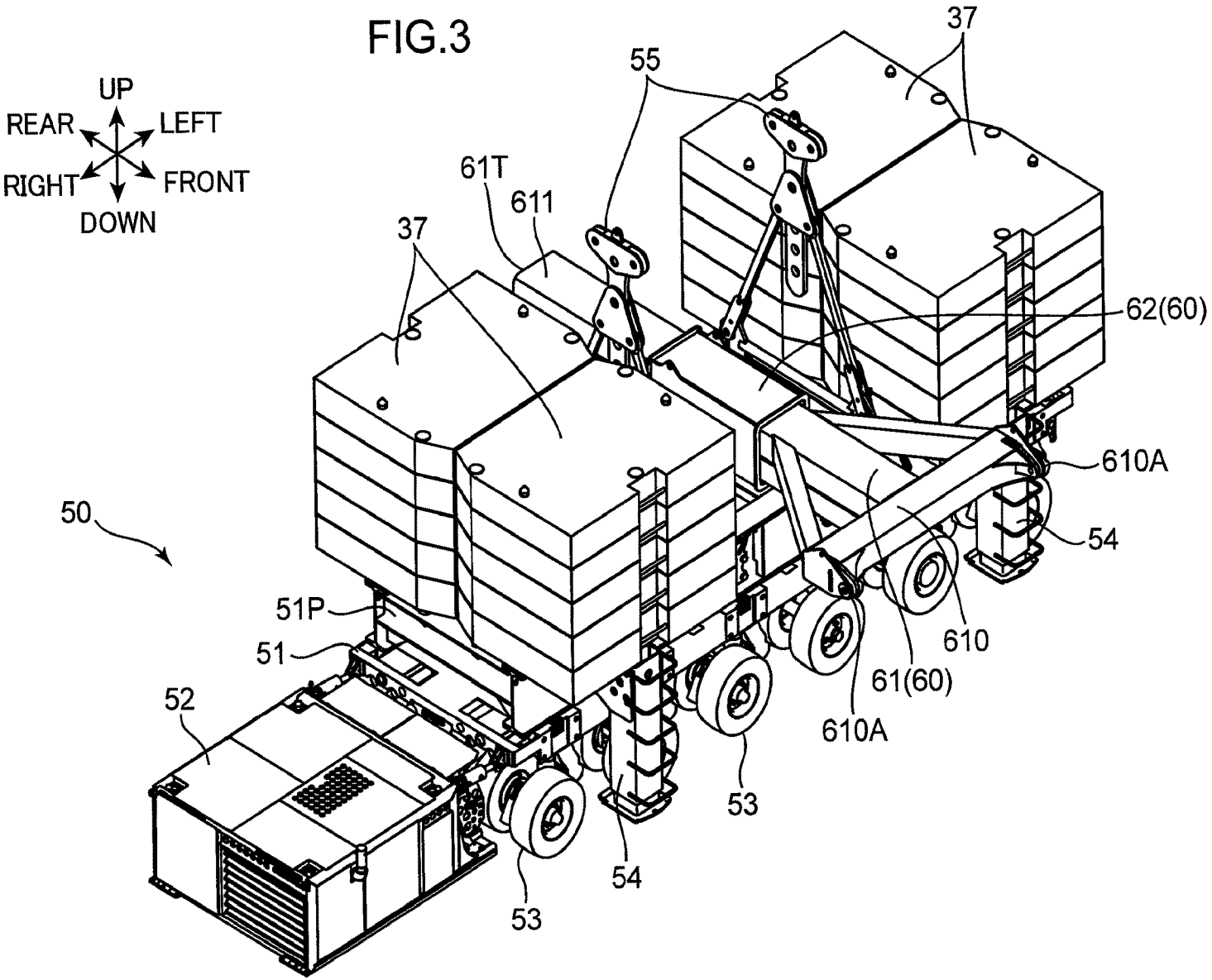
FIG. 3 is a perspective view of a self-propelled transporter and a counterweight according to the embodiment of the present invention.
Figure 4:
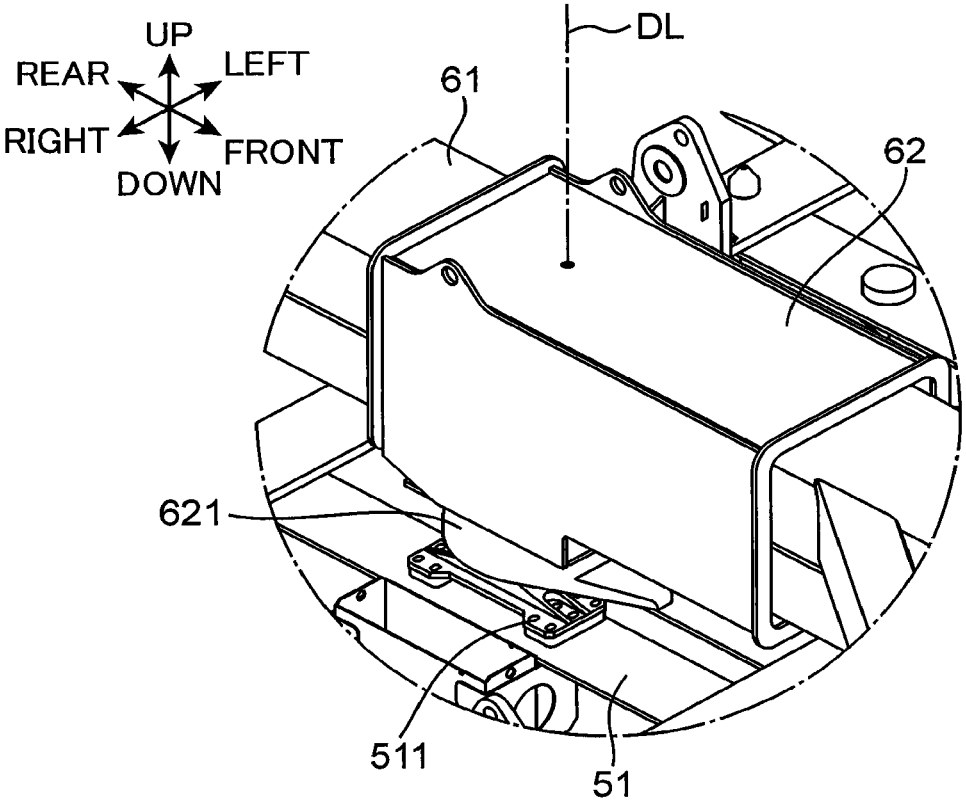
FIG. 4 is a perspective view of a connecting portion between a connecting beam of a crane and a self-propelled transporter according to the embodiment of the present invention.

FIG. 3 is a perspective view of the self-propelled transporter 50 of the crane 10 according to the present embodiment and the counterweight 37 mounted thereto. FIG. 4 is a perspective view of a connecting portion between the connecting beam 60 and the self-propelled transporter 50 of the crane 10 according to the present embodiment.

Referring to FIG. 3, the self-propelled transporter 50 has a transporter body 51 (loading platform), a power pack 52, a plurality of wheel units 53, four outriggers 54, and a pair of right and left guy-link connecting portions 55.

The transporter body 51 is a main body portion of the self-propelled transporter 50 (loading platform), and has a rectangular shape in plan view (a shape extending in a horizontal predetermined direction). The transporter body 51 is arranged so as to extend along the right-left direction of the upper slewing body 11 as shown in FIGS. 2 and 3 when the crane 10 is used. As a result, a plurality of counterweights 37 mounted on the self-propelled transporter 50 can stably maintain the balance of the crane 10. On the upper surface portion of the transporter body 51, a pallet 51P for placing the counterweight 37 is fixed. The pallet 51P also has the same shape as the transporter body 51 in a plan view. As shown in FIG. 3, the plurality of counterweights 37 are stacked at intervals in the right-left direction on the pallet 51P. In the present embodiment, the counterweight 37, the pallet 51P and the self-propelled transporter 50 are configured to be fixed to each other and integrally operated, and possibly configure a weight unit.

The power pack 52 is provided at one end of the transporter body 51 in the longitude direction. The power pack 52 includes a power generator, such as an engine, a hydraulic pump driven by the engine, a controller for controlling them, and a driver's cab (both of which are not shown in detail). Incidentally, the self-propelled transporter 50 may be remotely operated without having the driver's cab.

A plurality of wheel units 53 includes wheels 531 (FIG. 5) respectively rollable on a traveling surface G (ground) below the transporter body 51, and are arranged so as to be aligned in two rows along the longitude direction of the transporter body 51 on both sides in the width direction of the transporter body 51. Each wheel unit 53 is mounted on the lower portion of the transporter body 51 so as to be rotatable relative to the transporter body 51 about a steering center axis C2 (FIG. 5) extending in the vertical direction. Each wheel unit 53 is rotated about the steering center axis C2 to change the direction of the wheel 531.

Four outriggers 54 are respectively disposed in the vicinity of the four corners of the pallet 51P, and have cylinder constructions which expand and contract vertically by hydraulic pressure. Incidentally, in FIG. 3, only portions of the outriggers 54 appear. When the outriggers 54 are extended, the pallet 51P on which the counterweight 37 is placed moves upward and floats upward with respect to the transporter body 51 of the self-propelled transporter 50. Consequently, the self-propelled transporter 50 can enter into and go out of the space below the pallet 51P. When the outrigger 54 is contracted, the pallet 51P on which the counterweight 37 is placed is placed on the transporter body 51 of the self-propelled transporter 50, the load of the counterweight 37 is applied to the transporter body 51.

The pair of right and left guy-link connecting portions 55 are respectively connected to lower end portions of the pair of right and left weight guy-links 36 depending from the distal end portion of the HL mast 14, and is fixed on the pallet 51P at spaced intervals in the right-left direction. Incidentally, as shown in FIG. 3, between the pair of right and left guy-link connecting portions 55, the connecting beams 60 for connecting the upper slewing body 11 and the self-propelled transporter 50 (pallet 51P) is disposed.

The connecting beam 60 is a connecting body capable of connecting the rear end portion of the upper slewing body 11 and the self-propelled transporter 50 which supports the counterweight 37 at the rear of the upper slewing body 11 and is capable of traveling on the ground. In the present embodiment, via the pallet 51P described above, the connecting beam 60 and the self-propelled transporter 50 are connected to each other. In other embodiments, the connecting beam 60 may be connected directly to the transporter body 51 or the like of the self-propelled transporter 50 without the pallet 51P. The connecting beam 60 has a beam body 61 and a slider 62 (movable portion).

The beam body 61 (FIG. 3) has a transverse beam 610 and a longitudinal beam 611 (front-rear beam).

The longitudinal beam 611 extends in the front-rear direction of the upper slewing body 11 and is a columnar member for supporting the slider 62 reciprocally movable (slidable).

The transverse beam 610 is connected to the longitudinal beam 611 so as to extend from the front end portion of the longitudinal beam 611 to the right-left direction both sides of the upper slewing body 11. At the right and left end portions of the transverse beam 610, a pair of right and left slewing body connecting portions 610A are respectively disposed. The pair of right and left slewing body connecting portions 610A is connected to a pair of right and left side plates 11A (FIG. 2) of the upper slewing body 11 (rear end portion of the upper slewing body 11) respectively. Each slewing body connecting portion 610A has a pair of plate-shaped portions disposed at intervals from each other in the right-left direction, and each plate-shaped portion is formed of pin hole (not shown) coaxially. Then, the pair of plate-like portions are respectively arranged so as to sandwich the right and left side plates 11A of the upper slewing body 11 from both right and left sides, and the slewing body connecting portion 610A and the side plate 11A are connected to each other by connecting pin (not shown). The connecting by the above connecting pin is performed respectively in the pair of right and left slewing body connecting portions 610A of FIG. 2. Consequently, the connecting beams 60 is supported on a pair of side plate 11A of the upper slewing body 11 so as to be rotatable vertically about the connecting pin extending in the right-left direction. When the connecting beam 60 and the upper slewing body 11 is connected, the beam body 61 extends rearwardly from the upper slewing body 11.

The slider 62 is relatively movable in the front-rear direction with respect to the slewing body connecting portion 610A in conjunction with the traveling of the self-propelled transporter 50 in the direction including the front-rear direction. Specifically, the slider 62 has a rectangular tubular shape (cylindrical shape) which is reciprocally fitted on the longitudinal beam 611 of the beam body 61 along the front-rear direction. The slider 62 has a transporter connecting portion 621 which is connected to the self-propelled transporter 50. In the present embodiment, the transporter connecting portion 621, by being connected to the slider connecting portion 511 of the pallet 51P (FIG. 4), is connected to the self-propelled transporter 50 via the pallet 51P. Further, with the connection between the transporter connecting portion 621 and the slider connecting portion 511, the slider 62 is connected to the self-propelled transporter 50 so as to be rotatable about the rotation center axis DL (FIG. 4) extending in the vertical direction.

The beam body 61 supports the slider 62 reciprocally along the front-rear direction while restraining the slider 62 in the right-left direction of the upper slewing body 11 so as to enable the self-propelled transporter 50 to move relative to the upper slewing body 11 in the front-rear direction by traveling in the direction including the front-rear direction of the self-propelled transporter 50. Further, in the present embodiment, the upper slewing body 11 can turn by the traveling of the self-propelled transporter 50. Accordingly, the beam body 61 supports the slider 62 so as to enable the upper slewing body 11 to pivot by traveling of the self-propelled transporter 50 in the slewing direction around the slewing center axis.

Incidentally, in other words, regarding the relationship between the beam body 61 and the slider 62, the beam body 61 has a beam rear end portion 61T (FIG. 3) disposed on the opposite side of the pair of the slewing body connecting portion 610A in the front-rear direction of the upper slewing body 11, and the distance between the beam rear end portion 61T and the right and left pair of slewing body connecting portion 610A is maintained constant. Then, the slider 62 is reciprocable along the front-rear direction between the pair of right and left slewing body connecting portions 610A and the beam rear end portion 61T.

Figure 5:
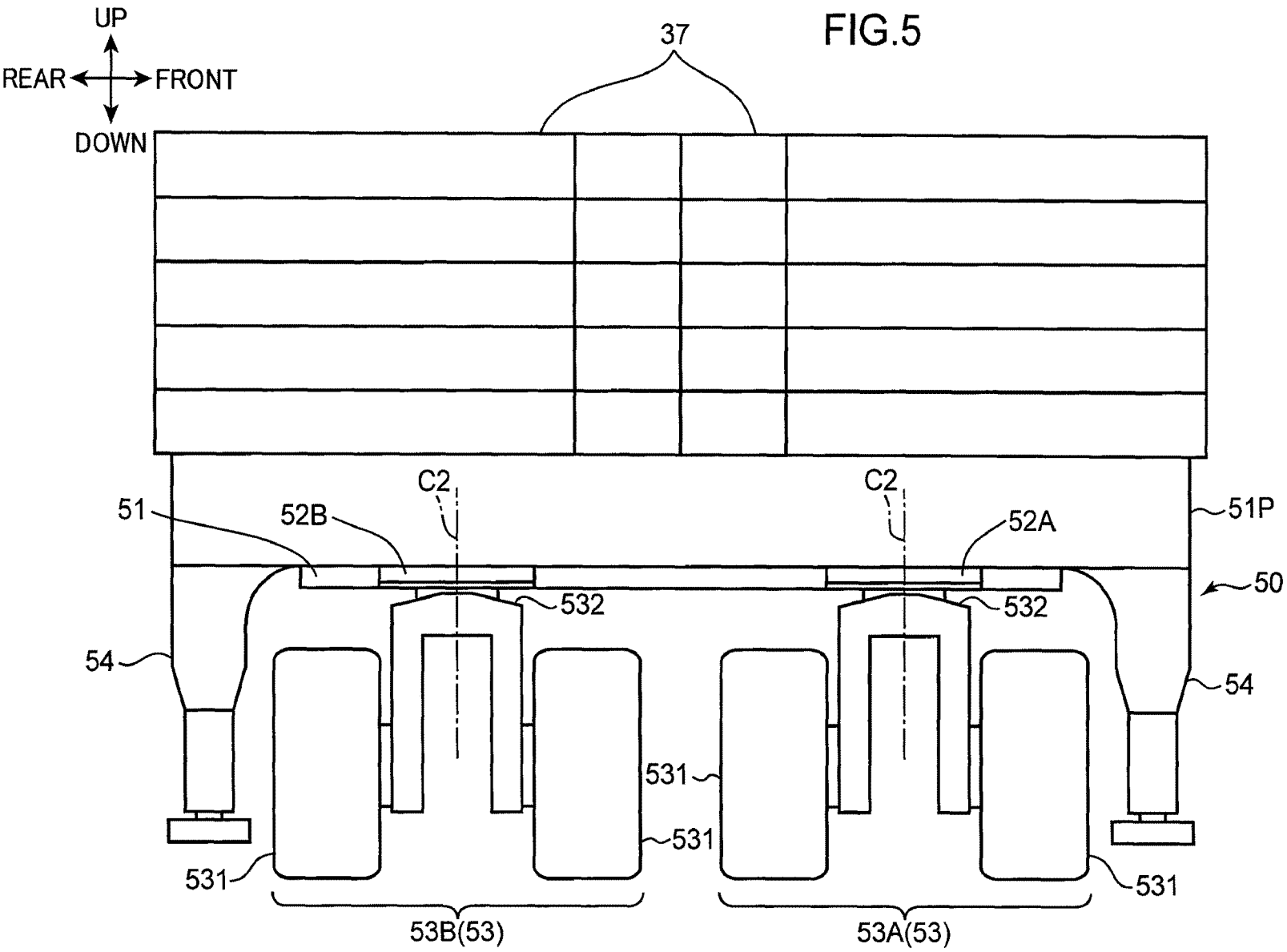
FIG. 5 is a side view of the self-propelled transporter according to the embodiment of the present invention.
Figure 6:
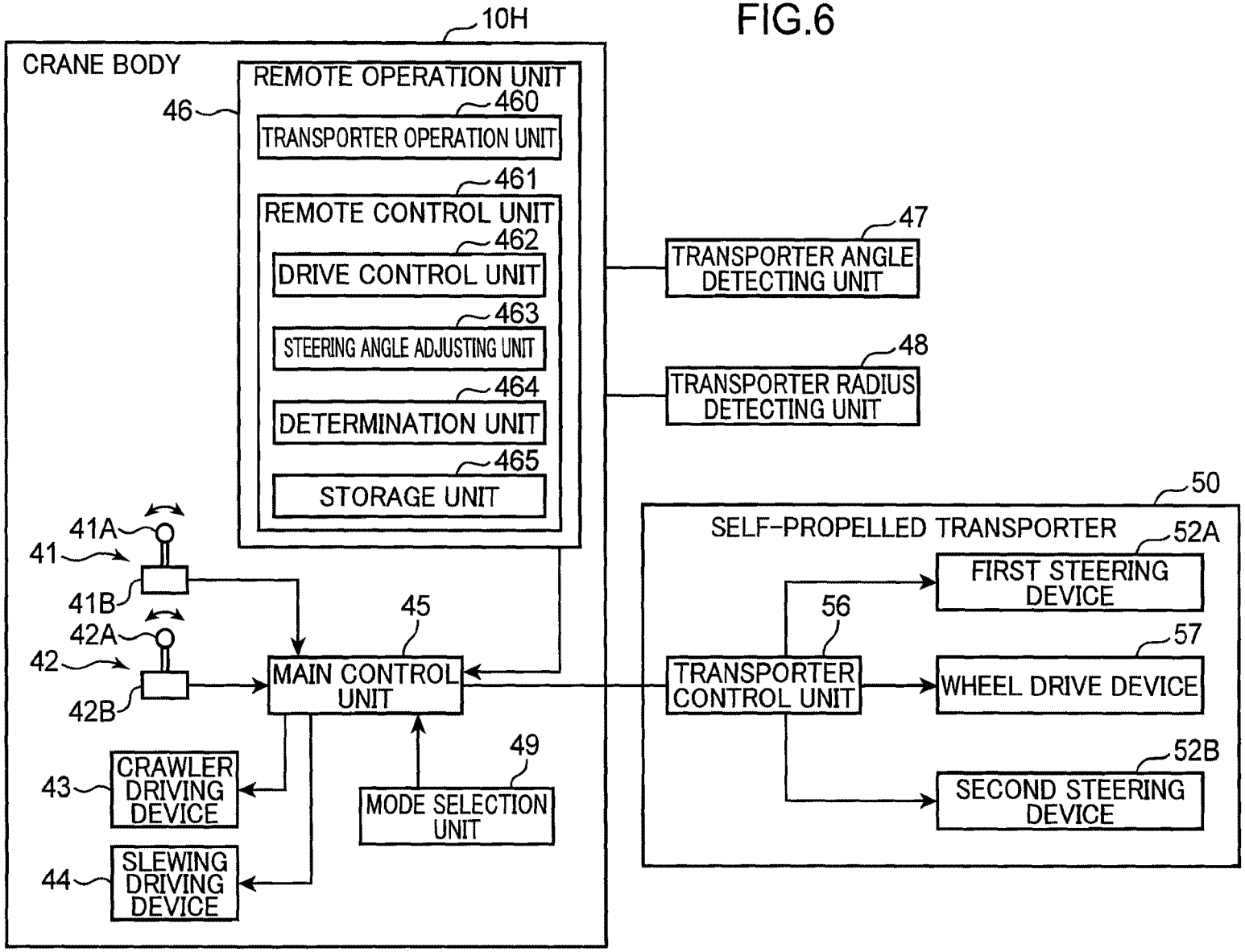
FIG. 6 is a block diagram of the crane and the self-propelled transporter according to the embodiment of the present invention.
Figure 7:
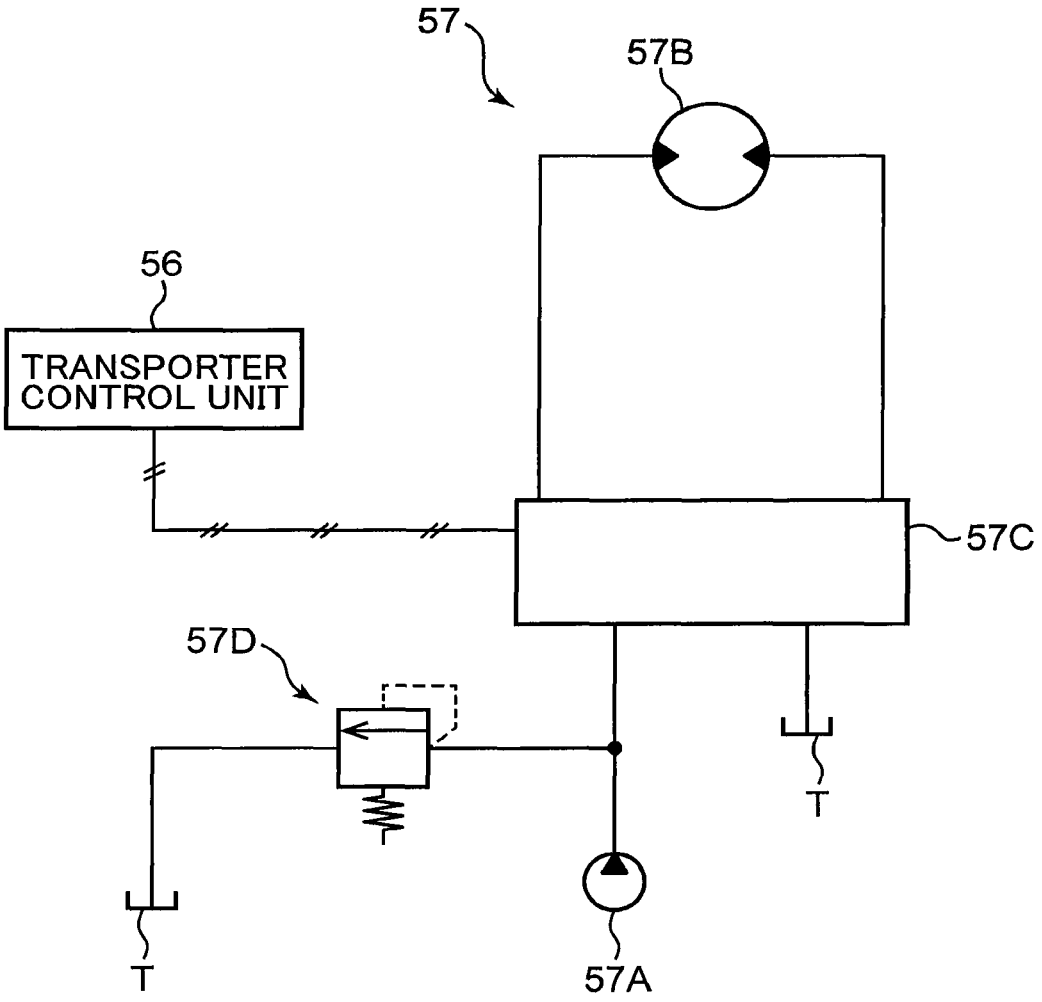
FIG. 7 is a hydraulic circuit diagram showing a wheel drive device of the self-propelled transporter according to the embodiment of the present invention.
Figure 8:
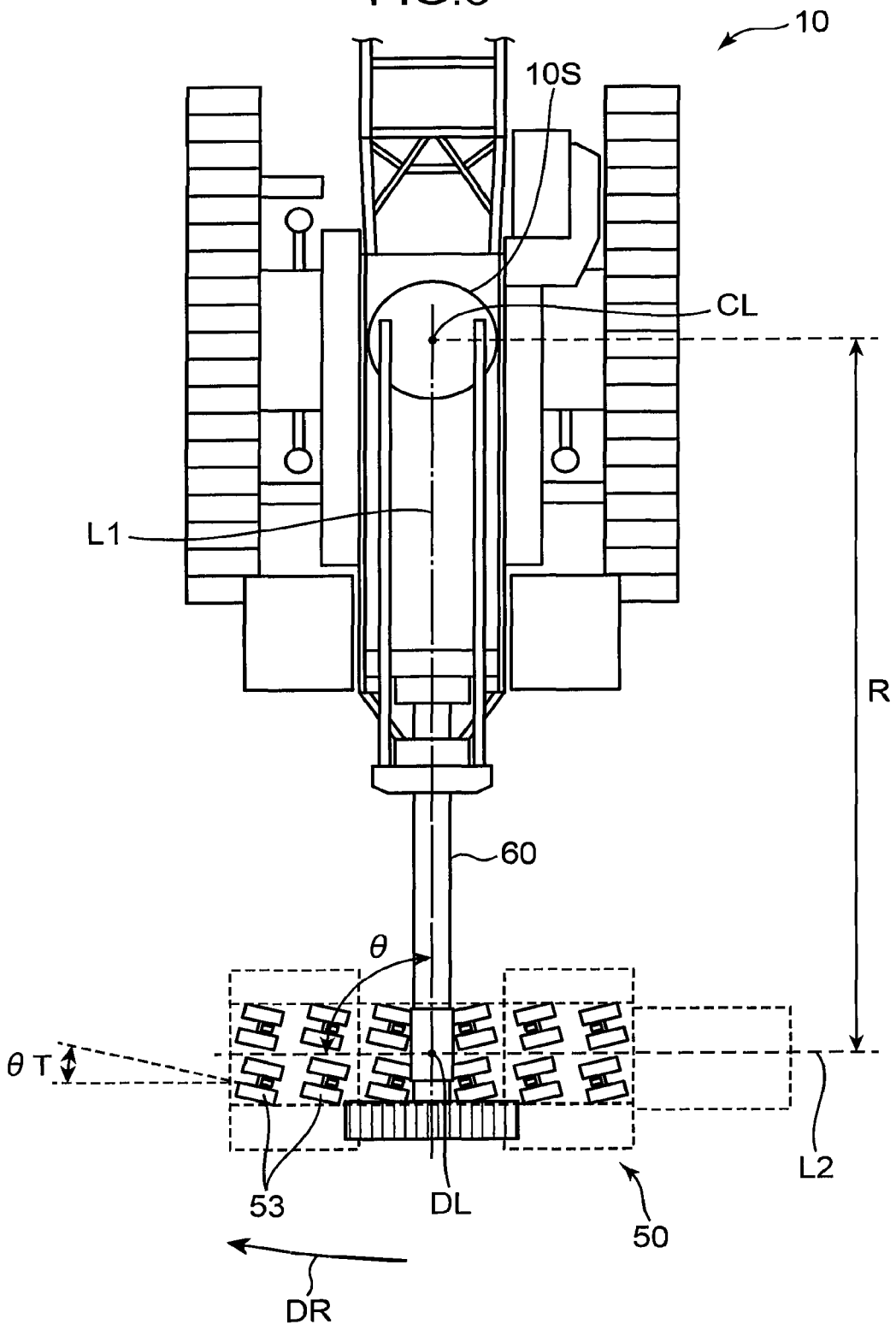
FIG. 8 is a plan view of the crane for showing a transporter radius, a transporter angle, and a steering angle of the self-propelled transporter according to the embodiment of the present invention.

FIG. 5 is a side view of the self-propelled transporter 50 according to the present embodiment. FIG. 6 is a block diagram of the crane 10 and the self-propelled transporter 50 according to this embodiment. FIG. 7 is a hydraulic circuit diagram illustrating a wheel drive device of the self-propelled transporter 50 according to the present embodiment. FIG. 8 is a plan view of the crane 10 for showing the transporter radius, the transporter angle, and the steering angle of the self-propelled transporter 50 according to the present embodiment.

In the present embodiment, as shown in FIG. 5, a plurality of wheel units 53 includes a plurality of first wheel units 53A and a plurality of second wheel units 53B. The plurality of first wheel units 53A is disposed on a side (front side) close to the upper slewing body 11 along the longitudinal direction of the transporter body 51. The plurality of second wheel units 53B is disposed on a side (rear side) far from the upper slewing body 11 along the longitudinal direction of the transporter body 51. Each of the plurality of first wheel units 53A and each of the plurality of second wheel units 53B (both wheel steering portions) include a pair of wheels 531 facing in the same direction as each other, and a wheel support frame 532 supporting these wheels 531. By the wheels 531 rotating about a rotation center axis parallel to the traveling surface G (rolling on the traveling surface G), it is possible for the self-propelled transporter 50 to self-propel independently of the lower traveling body 12.

Furthermore, the plurality of first wheel units 53A and the plurality of second wheel units 53B are respectively mounted to the transporter body 51 so as to be pivotable about the steering center axis C2 parallel to the slewing center axis CL. By changing the direction of each wheel 531 with the rotation of the plurality of first wheel units 53A and the plurality of second wheel units 53B about the steering center axis C2, the self-propelled transporter 50 has a plurality of transporter traveling modes corresponding to different movements of the crane body 10H (the upper slewing body 11, the lower traveling body 12).

The plurality of transporter traveling modes includes a slewing traveling mode (transporter slewing operation), a translational traveling mode, and a transporter slewing mode (transporter slewing operation).

(A) In the slewing traveling mode, the wheels 531 are driven to rotate in a state where the direction of each of the wheels 531 coincides with the slewing direction of the upper slewing body 11, so that the self-propelled transporter 50 travels in the slewing direction of the upper slewing body 11 following the slewing of the upper slewing body 11. That is, in this slewing traveling mode, the self-propelled transporter 50 travels along an arc-shaped track centered on the slewing center axis CL of the upper slewing body 11.

(B) The translational traveling mode is a mode in which the self-propelled transporter 50 travels following the traveling of the lower traveling body 12 by rotating and driving the wheels 531 in a state in which the slewing angle of the upper slewing body 11 is at an arbitrary angle and the directions of the wheels 531 coincide with the front-rear direction of the lower traveling body 12. That is, in this translational traveling mode, the self-propelled transporter 50 travels in the same direction as the lower traveling body 12, that is, in translation with the lower traveling body 12.

(C) The transporter slewing mode is a mode in which the upper slewing body 11 is towed in the slewing direction while the self-propelled transporter 50 travels along the arc-shaped track in a state in which the slewing brake of the upper slewing body 11 is opened in comparison with the slewing traveling mode. In this case, the upper slewing body 11 is driven to pivot by the self-propelled transporter 50. Incidentally, both the slewing traveling mode and the transporter slewing mode correspond to the transporter slewing operation of the present invention.

Next, the drive control system mounted on the mobile crane will be described with reference to FIG. 6. The crane body 10H includes a traveling operation device 41 as shown in FIG. 6, a slewing operation device 42, a crawler driving device 43, a slewing driving device 44, a main control unit 45, a remote operation unit 46 and a mode selection unit 49.

The crawler driving device 43 is a traveling driving device for traveling of the lower traveling body 12, the lower traveling body 12 is self-propelled by driving a pair of right and left crawlers provided in the lower traveling body 12.

The traveling operation device 41 is used to instruct the traveling (forward or backward) and the traveling stop of the lower traveling body 12, and is provided in the cab 10K included in the upper slewing body 11. The traveling operation device 41 includes a traveling operation lever 41A and an operation device main body 41B. The traveling operation lever 41A is given with a rotation operation by an operator for specifying a traveling direction and a traveling speed of the lower traveling body 12. The operation device main body 41B generates a command signal for the traveling direction corresponding to the direction of the operation given to the traveling operation lever 41A and the traveling speed corresponding to the amount of the operation, and inputs the command signal to the main control unit 45.

The slewing driving device 44 is a driving device for slewing the upper slewing body 11 about the slewing center axis CL.

The slewing operation device 42 is intended to be used to instruct the slewing drive and slewing stop of the upper slewing body 11, and is provided in the cab 10K. The slewing operation device 42 includes a slewing operation lever 42A, and an operation device main body 42B. The slewing operation lever 42A is given with a slewing operation for instructing a slewing direction and a slewing speed of the upper slewing body 11 by the operator. The operation device main body 42B generates a command signal for the slewing direction corresponding to the direction of the operation given to the slewing operation lever 42A and the slewing speed corresponding to the amount of the operation, and inputs the command signal to the main control unit 45.

The mode selection unit 49 is used to specify the transporter traveling mode for the traveling of the self-propelled transporter 50, that is, the transporter traveling mode that is to be executed by the operator selecting a desired transporter traveling mode from among a slewing traveling mode, a translational traveling mode, and a transporter slewing mode that are set as described above. Specifically, the mode selection unit 49 includes, for example, a plurality of selection buttons and is operated by the operator to select the transporter traveling mode, and inputs a mode selection signal for specifying the selected transporter traveling mode to the main control unit 45.

The main control unit 45 performs various controls in the crane body 10H on the basis of signals input from the traveling operation device 41, the slewing operation device 42, and the mode selection unit 49, respectively. Concretely, the following control is carried out.

(1) Drive Control on the Main Body Side

In this control, the main control unit 45, based on a command signal (a travel command signal) input from the traveling operation device 41, generates a travel control signal and inputs it to the crawler driving device 43 thereby the main control unit 45 controlling the crawler of the crawler driving device 43 so as to travel the lower traveling body 12 in a traveling direction corresponding to the operation given to the traveling operation lever 41A of the traveling operation device 41 and at a traveling speed corresponding to the operation.

(2) Slewing Drive Control

In this control, the main control unit 45, based on a command signal (slewing command signal) input from the slewing operation device 42, generates a slewing control signal and inputs it to the slewing driving device 44, thereby the main control unit 45 controlling the slewing driving device 44 so as to rotate the upper slewing body 11 in a slewing direction corresponding to the operation given to the slewing operation lever 42A of the slewing operation device 42 and at a slewing speed corresponding to the operation.

(3) Transporter Slewing Control

In this control, the main control unit 45, regardless of the command signal input from the slewing operation device 42, inputs a brake opening command signal to the slewing driving device 44 so as to open the slewing brake (not shown) for applying a predetermined brake torque to the upper slewing body 11, and brings the upper slewing body 11 into a free rotatable state against the lower traveling body 12. As a result, as will be described later, in accordance with a transporter slewing operation given to the remote operation unit 46 by the operator, the upper slewing body 11 can be turned by the traveling force of the self-propelled transporter 50.

(4) Mode Switching Control

The main control unit 45 inputs a mode command signal to a transporter control unit 56 to be described later so as to realize the transporter traveling mode selected by the operator using the mode selection unit 49. Specifically, the main control unit 45, based on a mode selection signal input from the mode selection unit 49, determines the transporter traveling mode that is selected, and generates and inputs the mode command signal for the transporter traveling mode to the transporter control unit 56.

The remote operation unit 46 is disposed within the cab 10K of the upper slewing body 11 and can be operated by the operator. The remote operation unit 46 includes a transporter operation unit 460 and a remote control unit 461.

The transporter operation unit 460 is given operations from the operator and includes an operation lever or an operation button (not shown). Such operations include steering directions (steering angles), rotational directions, rotational speeds and the like of the wheels 531 of each wheel unit 53 of the self-propelled transporter 50.

The remote control unit 461 includes a CPU (Central Processing Unit), a ROM (Read Only Memory) for storing a control program, a RAM (Random Access Memory) used as a working area of the CPU and the like, and operates to functionally have a drive control unit 462 (a driving signal input unit, a steering signal input unit, a command signal input unit), a steering angle adjusting unit 463 (a steering angle setting unit), a determination unit 464 and a storage unit 465 by the CPU executing the control program.

The drive control unit 462 inputs a command signal (traveling command signal, steering command signal) to a wheel drive device 57 (wheel drive unit) described later, the first steering device 52A and the second steering device 52B in order to roll and steer the plurality of wheels 531 in response to the aforementioned operation given to the transporter operation unit 460. The command signal is input to the transporter control unit 56 via the main control unit 45. Incidentally, in FIG. 6, the main control unit 45 and the transporter control unit 56 are connected to each other by wired communication or wireless communication.

Further, the drive control unit 462, during the transporter slewing operation, inputs the traveling command signal to the wheel drive device 57 of the self-propelled transporter 50 in order to roll the plurality of wheels 531. Incidentally, the transporter slewing operation is an operation in which the self-propelled transporter 50 travels on the traveling surface G in the slewing direction around the slewing center axis CL in cooperation with the rotation of the upper slewing body 11 in a state where the upper slewing body 11 and the self-propelled transporter 50 are connected to each other by a connecting beam 60 and the rotation center axis DL is disposed on the circumference of a predetermined initial radius around the slewing center axis CL in a plan view.

The steering angle adjusting unit 463 executes the steering angle adjusting operation of the wheel 531 when the aforementioned slewing traveling mode or the transporter slewing mode is being executed. The steering angle adjusting unit 463 sets the respective steering angles of the plurality of wheels 531 with respect to the transporter longitudinal direction in accordance with the transporter angle θ detected by the transporter angle detecting unit 47 (FIG. 6) described later and the transporter radius R detected by the transporter radius detecting unit 48 so that the transporter angle θ is set to 90 degrees (as approaching 90 degrees) in response to the transporter slewing operation. When the steering angle adjusting unit 463 sets the steering angle, the above-described drive control unit 462 inputs the steering command signal corresponding to the steering angle set by the steering angle adjusting unit 463 to the first steering device 52A and the second steering device 52B of the self-propelled transporter 50. Incidentally, "transporter angle θ is 90 degrees" means that the transporter angle θ is included in a predetermined target angle including 90 degrees. The above target angle is, for example, 80 degrees or more 100 degrees or less, more desirably, 85 degrees or more 95 degrees or less.

The determination unit 464 executes various determination operations in the steering angle adjusting operation described above.

The storage unit 465 stores in advance a threshold value, a reference parameter and the like to be referred to in each transporter traveling mode.

Referring to FIG. 8, with the slewing of the upper slewing body 11 and the traveling of the self-propelled transporter 50, the self-propelled transporter 50 is relatively movable along the front-rear direction of the upper slewing body 11 with respect to the upper slewing body 11, and is relatively rotatable about the rotation center axis DL with respect to the upper slewing body 11.

The distance between the slewing center axis CL and the rotation center axis DL is defined as the transporter radius R of the self-propelled transporter 50 (the radius of the self-propelled transporter 50 around the slewing center axis CL). Further, the angle formed by the first reference line L1 and the second reference line L2 in the traveling direction side of the self-propelled transporter 50 and the upper slewing body 11 side is defined as a transporter angle θ. The first reference line L1 is a horizontal straight line connecting the slewing center axis CL and the rotation center axis DL. The second reference line L2 is a straight line parallel to the longitudinal direction (the transporter longitudinal direction, the straight driving direction) which is a direction in which the transporter body 51 of the self-propelled transporter 50 extends longitudinally, and the straight line passing through the rotation center axis DL. In other words, the transporter angle θ is an angle formed by a line segment connecting the slewing center axis CL and the rotation center axis DL and a line segment extending from the rotation center axis DL in the straight driving direction of the self-propelled transporter 50. Furthermore, an angle (a sharp angle) formed by the longitudinal direction (a straight driving direction of the self-propelled transporter 50) of the transporter body 51 of the self-propelled transporter 50 and the steering direction (a horizontal direction perpendicular to the rotation axis of the wheel 531) of the wheel 531 of the wheel unit 53 is defined as the steering angle θT of the wheel 531. When the self-propelled transporter 50 travels toward the direction parallel to the longitudinal direction of the transporter body 51 by the plurality of wheels 531 (when traveling straight), the steering angle θT is set to 0 degree. The shape of the transporter body 51 is not limited to the shape as described above. Regardless of the shape of the transporter body 51, the second reference line L2 may be set to be parallel to the straight driving direction of the self-propelled transporter 50.

Further, the crane 10 includes a transporter angle detecting unit 47 and a transporter radius detecting unit 48 (FIG. 6).

The transporter angle detecting unit 47 can detect the transporter angle θ. The transporter angle detecting unit 47 is composed of a known angle meter provided in the slider 62, an encoder and the like. Incidentally, the transporter angle detecting unit 47 may be one that detects an outer angle and the like of the transporter angle θ defined above.

The transporter radius detecting unit 48 detects the transporter radius R described above. As an example, the transporter radius detecting unit 48 is a laser displacement meter fixed to the upper surface portion of the slider 62, and emits the detection laser toward the target (not shown) disposed at the rear end of the upper slewing body 11, and detects the distance between the rotation center axis DL (self-propelled transporter 50) on the slider 62 and the target by detecting its reflected light. By adding the distance between the target and the slewing center axis CL to the detecting distance, the transporter radius R is detectable. Incidentally, the transporter radius detecting unit 48 is not limited to the laser displacement meter and may be a wire type displacement meter or the like. The wire type displacement meter is a measuring instrument for electrically outputting the length of the wire drawn from a spool, while the measuring instrument body is fixed to the slider 62, and the tip of the wire is fixed to the upper slewing body 11. Incidentally, a spring for biasing in a direction of winding the wire is disposed on the spool. By measuring the rotation amount of the spool with a potentiometer and the like, it is possible to detect the distance between the slider 62 (self-propelled transporter 50) and the upper slewing body 11 (slewing center axis CL).

The self-propelled transporter 50 further includes, as shown in FIG. 6, a first steering device 52A, a second steering device 52B, a transporter control unit 56, and a wheel drive device 57 as drive control systems.

The first steering device 52A and the second steering device 52B (FIGS. 5 and 6) (both wheel steering portions) are attached to each of the first wheel unit 53A and each of the second wheel unit 53B to steer the wheels 531 included in the wheel units by turning the corresponding wheel unit 53A or 53B about the steering center axis C2 with respect to the transporter body 51. Each steering device 52A, 52B includes a steering motor for turning the wheel units 53A, 53B, and a steering control circuit for controlling the operation of the steering motor in response to a command signal (steering command signal) input from the transporter control unit 56.

The wheel drive device 57 (wheel drive unit) is attached to at least one of the first wheel unit 53A and the second wheel unit 53B, and rotates (rolling) the wheel 531 belonging to the attached wheel unit in a direction corresponding to the input command signal (traveling command signal) from the transporter control unit 56 and at a speed corresponding to the command signal to run the self-propelled transporter 50.

The wheel drive device 57 includes a hydraulic pump 57A as shown in FIG. 7, a hydraulic motor 57B, a wheel drive control circuit 57C and a relief valve 57D.

The hydraulic motor 57B is for operating the wheel 531 to rotate, the hydraulic pump 57A is for supplying hydraulic oil to the hydraulic motor 57B. The hydraulic motor 57B rotationally drives the wheel 531 with a driving force corresponding to the pressure of the hydraulic oil supplied, that is, the driving pressure. The hydraulic motor 57B has a pair of ports and an output shaft (not shown) coupled to the wheel 531. The output shaft rotates in a direction corresponding to the supplied port by hydraulic oil being supplied from the hydraulic pump 57A to any of the ports of the hydraulic motor 57B through the wheel drive control circuit 57C, thereby rotating the wheel 531 in the direction. At the same time, the hydraulic motor 57B discharges hydraulic oil from the other port. The hydraulic oil is returned to the tank T through the wheel drive control circuit 57C.

The wheel drive control circuit 57C is interposed between the hydraulic motor 57B and the hydraulic pump 57A, and changes the direction and flow rate of supplying hydraulic oil from the hydraulic pump 57A to the hydraulic motor 57B in response to an input of a command signal from the transporter control unit 56. The wheel drive control circuit 57C includes, for example, a control valve composed of a pilot switching valve for switching the oil path between the hydraulic pump 57A and the hydraulic motor 57B, a pilot line for supplying pilot pressure to the control valve, and an solenoid proportional pressure reducing valve provided in the pilot line, by receiving a command signal from the transporter control unit 56 to the solenoid proportional pressure reducing valve, the control of the supply direction and the supply flow rate of the hydraulic oil, i.e. the control of the rotational direction and the rotational speed of the wheel 531 is performed.

The relief valve 57D is connected to an oil passage between the hydraulic pump 57A and the wheel drive control circuit 57C. The relief valve 57D is for releasing a portion of the hydraulic oil discharged from the hydraulic pump 57A to the tank T without supplying to the hydraulic motor 57B.

Figure 9:
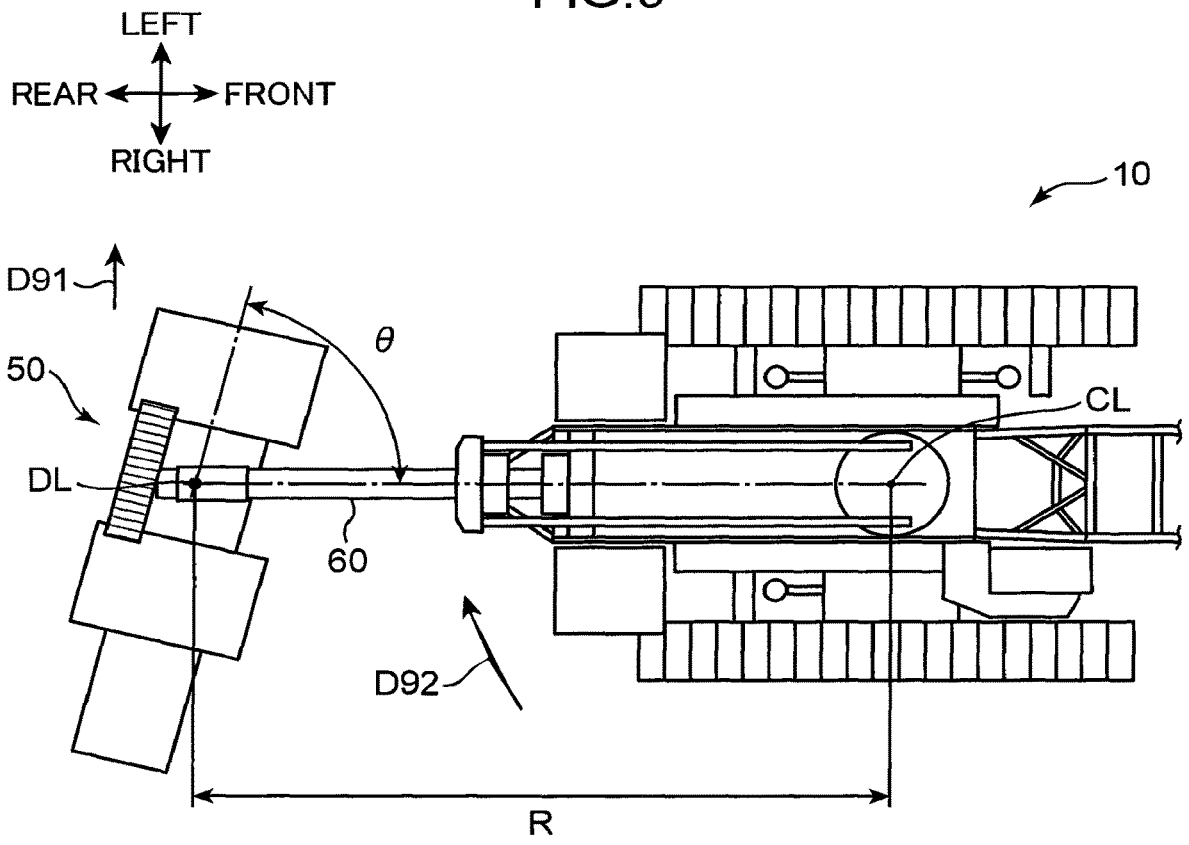
FIG. 9 is a plan view illustrating a state in which the self-propelled transporter rotates the upper slewing body of the crane according to the embodiment of the present invention.
Figure 10:
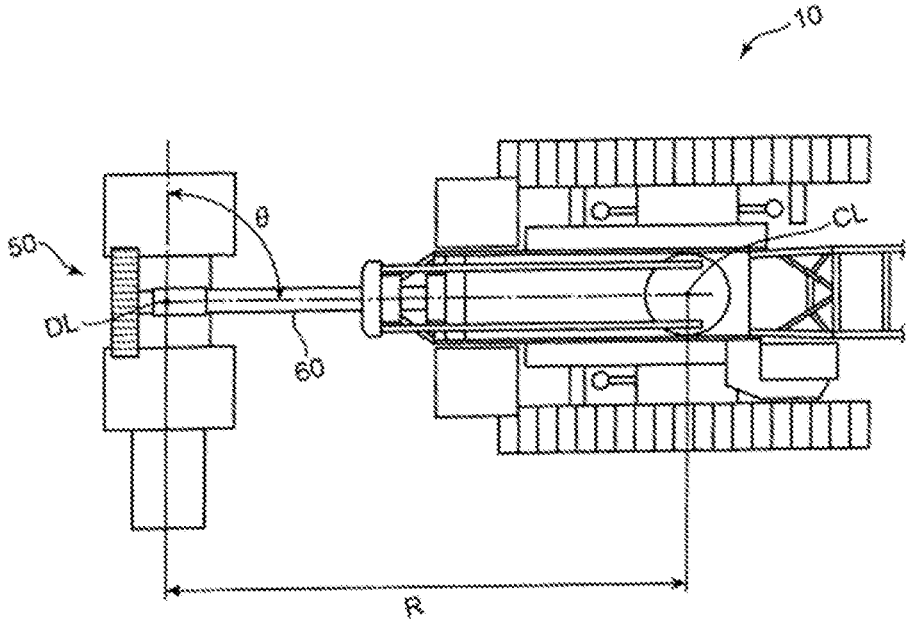
FIG. 10 is a plan view showing a state in which the self-propelled transporter has rotated the upper slewing body from the state of FIG. 9.
Figure 11:
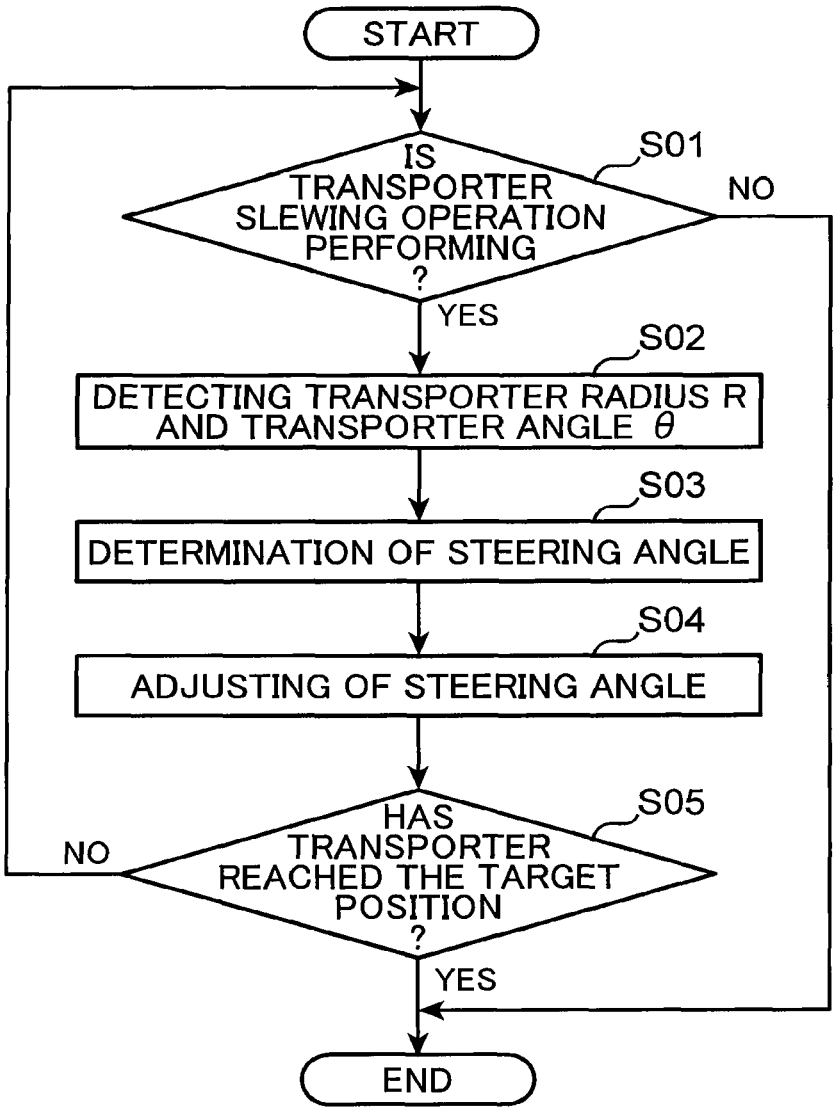
FIG. 11 is a flowchart showing a state of steering angle control of the self-propelled transporter according to the embodiment of the present invention.

FIG. 9 is a plan view showing a state in which the self-propelled transporter 50 rotates the upper slewing body 11 of the crane 10 according to the present embodiment. FIG. 10 is a plan view showing a state after the self-propelled transporter 50 rotated the upper slewing body 11 from the state of FIG. 9. FIG. 11 is a flowchart illustrating a state of the steering angle adjusting operation of the self-propelled transporter 50 according to the present embodiment. Table 1 shows the information of the steering angle θT of the wheel 531 which is binarily set corresponding to the transporter radius R, the transporter angle θ, the information is stored in advance in the storage unit 465.

TABLE 1

| | | TRANSPORTER RADIUS (m) | | | | | | | | | | |
|---|---|---|---|---|---|---|---|---|---|---|---|---|
| | | 16.5 | 16.4 | 16.3 | 16.2 | 16.1 | 16 | 15.9 | 15.8 | 15.7 | 15.6 | 15.5 |
| TRANSPORTER ANGLE (degrees) | 64 | −5 | −4 | −3 | −2 | −1 | 0 | 1 | 2 | 3 | 4 | 5 |
| | 66 | −4 | −3 | −2 | −1 | 0 | 1 | 2 | 3 | 4 | 5 | 6 |
| | 68 | −3 | −2 | −1 | 0 | 1 | 2 | 3 | 4 | 5 | 6 | 7 |
| | 70 | −2 | −1 | 0 | 1 | 2 | 3 | 4 | 5 | 6 | 7 | 8 |
| | 72 | −1 | 0 | 1 | 2 | 3 | 4 | 5 | 6 | 7 | 8 | 9 |
| | 74 | 0 | 1 | 2 | 3 | 4 | 5 | 6 | 7 | 8 | 9 | 10 |
| | 76 | 1 | 2 | 3 | 4 | 5 | 6 | 7 | 8 | 9 | 10 | 11 |
| | 78 | 2 | 3 | 4 | 5 | 6 | 7 | 8 | 9 | 10 | 11 | 12 |
| | 80 | 3 | 4 | 5 | 6 | 7 | 8 | 9 | 10 | 11 | 12 | 13 |
| | 82 | 4 | 5 | 6 | 7 | 8 | 9 | 10 | 11 | 12 | 13 | 14 |
| | 84 | 5 | 6 | 7 | 8 | 9 | 10 | 11 | 12 | 13 | 14 | 15 |
| | 86 | 6 | 7 | 8 | 9 | 10 | 11 | 12 | 13 | 14 | 15 | 16 |
| | 88 | 7 | 8 | 9 | 10 | 11 | 12 | 13 | 14 | 15 | 16 | 17 |
| | 90 | 8 | 9 | 10 | 11 | 12 | 13 | 14 | 15 | 16 | 17 | 18 |
| | 92 | 9 | 10 | 11 | 12 | 13 | 14 | 15 | 16 | 17 | 18 | 19 |
| | 94 | 10 | 11 | 12 | 13 | 14 | 15 | 16 | 17 | 18 | 19 | 20 |
| | 96 | 11 | 12 | 13 | 14 | 15 | 16 | 17 | 18 | 19 | 20 | 21 |
| | 98 | 12 | 13 | 14 | 15 | 16 | 17 | 18 | 19 | 20 | 21 | 22 |
| | 100 | 13 | 14 | 15 | 16 | 17 | 18 | 19 | 20 | 21 | 22 | 23 |
| | 102 | 14 | 15 | 16 | 17 | 18 | 19 | 20 | 21 | 22 | 23 | 24 |
| | 104 | 15 | 16 | 17 | 18 | 19 | 20 | 21 | 22 | 23 | 24 | 25 |
| | 106 | 16 | 17 | 18 | 19 | 20 | 21 | 22 | 23 | 24 | 25 | 26 |
| | 108 | 17 | 18 | 19 | 20 | 21 | 22 | 23 | 24 | 25 | 26 | 27 |
| | 110 | 18 | 19 | 20 | 21 | 22 | 23 | 24 | 25 | 26 | 27 | 28 |

Next, a case will be described in which the operator operates the mode selection unit 49 within the cab 10K and selects the transporter slewing mode from among the three transporter traveling modes. As shown in FIG. 8, in this case, the self-propelled transporter 50 is disposed behind the upper slewing body 11 so that the first reference line L1 and the second reference line L2 are perpendicular to each other. At this time, the distance between the slewing center axis CL and the rotation center axis DL is set in advance to the initial radius (16 m in Table 1 as an example) set in accordance with the hanging capacity of the crane 10. Further, the steering angle adjusting unit 463 sets the steering angle θT (steering angle) of the wheels 531 of the plurality of wheel units 53 with respect to the straight-ahead direction to an angle set in advance in accordance with the above-mentioned initial radius (13 degrees (initial steering angle) corresponding to the transporter radius R 16 m and the transporter angle 90 degrees in Table 1). As a result, each of the plurality of wheels 531 is set to face the inside in the radial direction (FIG. 8).

When the transporter slewing mode is selected, regardless of the command signal input from the slewing operation device 42, the brake opening command signal is input to the slewing driving device 44 so as to open the slewing brake (not shown) for applying a predetermined brake torque to the upper slewing body 11.

When the operator operates the transporter operation unit 460 of the remote operation unit 46 to run the self-propelled transporter 50 in the slewing direction, a command signal is input to the wheel drive device 57 from the remote operation unit 46 via the main control unit 45 and the transporter control unit 56, whereby the self-propelled transporter 50 can start to travel on the circumference having the initial radius. As a result, the upper slewing body 11 is rotated while being towed by the self-propelled transporter 50.

When the operation of the transporter operation unit 460 by the operator is performed as described above, the determination unit 464 (FIG. 6) determines that the transporter slewing operation is performed by detecting a signal corresponding to the operation (YES in step S01). As a result, the transporter angle detecting unit 47 and the transporter radius detecting unit 48, respectively, detects the transporter angle θ and the transporter radius R (step S02).

Next, the steering angle adjusting unit 463 determines the appropriate steering angle θT of the wheel 531 based on the information in Table 1 stored in the storage unit 465 in accordance with the transporter angle θ and the transporter radius R detected by the transporter angle detecting unit 47 and the transporter radius detecting unit 48 (step S03). FIG. 9 shows a state in which the transporter angle θ is reduced to 84 degrees while the self-propelled transporter 50 is traveling. On the other hand, the transporter radius R remains at 16 m of the initial radius. In this case, the appropriate steering angle θT=10 degrees is set from the information in Table 1.

Next, the drive control unit 462 inputs a steering command signal corresponding to the steering angle θT set by the steering angle adjusting unit 463 to the first steering device 52A and the second steering device 52B of the self-propelled transporter 50. Consequently, the steering command signal is input to the first steering device 52A and the second steering device 52B, and the steering angle θT of the wheels 531 is adjusted.

Incidentally, when the steering angle θT as described above is set from the state shown in FIG. 9, since the steering angle θT of the wheel 531 is smaller than the case where the transporter angle θ is 90 degrees (initial steering angle), the self-propelled transporter 50, as indicated by the arrow D91, travels so as to move outward in the radial direction with respect to the current traveling direction. As a result, while the upper slewing body 11 is towed by the self-propelled transporter 50, it rotates clockwise about the slewing center axis CL (arrow D92). Finally, as shown in FIG. 10, the upper slewing body 11 catches up with the self-propelled transporter 50 in the slewing direction, so that the transporter angle θ becomes 90 degrees again. Incidentally, in the change of the state shown in FIG. 10 from FIG. 9, the distance between the rotation center axis DL and the slewing center axis CL varies. However, in the present embodiment, since the slider 62 of the connecting beam 60 is relatively movable with respect to the beam body 61, during control as described above, the change in the distance between the slewing center axis CL and the rotation center axis DL is allowed. As a result, as compared with other connecting members in which the distance between the slewing center axis CL and the rotation center axis DL is held constant, a large load is prevented from being applied to the connecting member and the rear end portion of the upper slewing body 11 when the position of the self-propelled transporter 50 is displaced.

Next, the determination unit 464 determines whether or not the self-propelled transporter 50 has reached the target position (step S05). In the determination, in advance a target slewing angle of the upper slewing body 11 has been set, and the determination unit 464 may determine whether or not the upper slewing body 11 turns to the target slewing angle described above. In this case, the upper slewing body 11 is provided with an angle detector detectable of the slewing angle stated above. In step S05, when the self-propelled transporter 50 (the upper slewing body 11) has reached the target position, the steering angle adjusting operation of FIG. 11 ends. On the other hand, when the self-propelled transporter 50 has not reached the target position in step SOS, the flow after step S01 is repeated. By such a flow is repeated at intervals of 1 second, for example, the steering angle of the wheels 531 of the self-propelled transporter 50 is adjusted while the upper slewing body 11 is slewing.

As described above, in the present embodiment, when the transporter slewing operation is performed in which the upper slewing body 11 is rotated by the traveling of the self-propelled transporter 50 or the self-propelled transporter 50 travels so as to follow the slewing operation of the upper slewing body 11, the transporter slewing operation can be performed by adjusting the steering angle θT of each wheel 531 so as to maintain the transporter angle θ at 90 degrees while allowing the self-propelled transporter 50 to move relative to the upper slewing body 11 without rigidly connecting the self-propelled transporter 50 and the upper slewing body 11. In particular, since the self-propelled transporter 50 is relatively movable in the front-rear direction with respect to the upper slewing body 11 via the connecting beam 60 and is relatively rotatable about the rotation center axis DL, a large load on the connecting beam 60 and the upper slewing body 11 is suppressed. As a result, damage to these members is suppressed. Further, even if the direction of each wheel 531 of the self-propelled transporter 50 may change due to the inclination of the ground or the unevenness of the road surface, the traveling of the self-propelled transporter 50 and the slewing of the upper slewing body 11 can be stably linked while maintaining the transporter angle θ, which is a relative angle of the self-propelled transporter 50 to the upper slewing body 11, around 90 degrees. Therefore, since the traveling direction of the self-propelled transporter 50 is maintained in the tangential direction with respect to the slewing direction, in the case in which the upper slewing body 11 turns by the traveling of the self-propelled transporter 50, the upper slewing body 11 can be efficiently turned by the traveling force of the self-propelled transporter 50, and in the case in which the self-propelled transporter 50 travels so as to follow the slewing operation of the upper slewing body 11, the traveling of the self-propelled transporter 50 is prevented from interfere the turning of the upper slewing body 11. Further, in the present embodiment, the traveling of the self-propelled transporter 50 capable of supporting the counterweight 37 and the slewing of the upper slewing body 11 of the crane 10 can be stably linked without the operator adjusting the steering direction of the wheels 531 of the self-propelled transporter 50 every time the traveling direction of the self-propelled transporter 50 is shifted.

In the present embodiment, as shown in Table 1, the steering angle adjusting unit 463 sets the steering angle θT larger than the initial steering angle and make the angle of the wheels 531 further radially inward when the transporter angle θ detected by the transporter angle detecting unit 47 is larger than 90 degrees. On the other hand, when the transporter angle θ detected by the transporter angle detecting unit 47 is smaller than 90 degrees, the steering angle adjusting unit 463 sets the steering angle θT smaller than the initial steering angle and steers each wheel 531 to be closer to the straight driving direction.

According to this configuration, when the transporter angle θ becomes larger than 90 degrees, since the self-propelled transporter 50 travels radially outward, the transporter angle θ can be made close to 90 degrees by setting the steering angle θT larger than the initial steering angle. On the other hand, when the transporter angle θ becomes smaller than 90 degrees, since the self-propelled transporter 50 travels radially inward, the transporter angle θ can be made close to 90 degrees by setting the steering angle θT smaller than the initial steering angle.

Further, in the present embodiment, as shown in Table 1, the steering angle adjusting unit 463 sets the steering angle θT larger as the transporter angle θ detected by the transporter angle detecting unit 47 is greater than 90 degrees, and sets the steering angle θT smaller as the transporter angle θ detected by the transporter angle detecting unit 47 is smaller than 90 degrees.

According to such a configuration, even if the transporter angle θ is rapidly increased due to the incline of the ground or the unevenness of the road surface while the self-propelled transporter 50 is traveling, the transporter angle θ can be brought close to 90 degrees at an early stage by setting the steering angle θT larger. Further, even if the transporter angle θ may be rapidly reduced due to the incline of the ground or unevenness of the road surface while the self-propelled transporter 50 is traveling, the transporter angle θ can be brought close to 90 degrees at an early stage by setting the steering angle θT smaller.

Further, in the present embodiment, the crane 10 further includes a transporter radius detecting unit 48 capable of detecting the transporter radius R. Then, the steering angle adjusting unit 463 sets the respective steering angle θT of the plurality of wheels 531 in accordance with the transporter angle θ detected by the transporter angle detecting unit 47 and the transporter radius R detected by the transporter radius detecting unit 48 so that the transporter angle θ approaches 90 degrees.

According to such a configuration, even if the direction of each wheel 531 of the self-propelled transporter 50 may change due to the inclination of the ground or the unevenness of the road surface, the traveling of the self-propelled transporter 50 and the slewing of the upper slewing body 11 can be stably linked while maintaining the transporter angle θ around 90 degrees. Therefore, the transporter can reach the destination at a position close to the circumference of the initial radius around the slewing center axis CL.

Further, the steering angle adjusting unit 463 sets the steering angle θT smaller than the case where the transporter radius R is the initial radius when the transporter radius R detected by the transporter radius detecting unit 48 is larger than the initial radius, and sets the steering angle θT larger than the case where the transporter radius R is the initial radius when the transporter radius R detected by the transporter radius detecting unit 48 is smaller than the initial radius.

According to such a configuration, when the transporter radius R becomes larger than the initial radius, the steering angle adjusting unit 463 sets the steering angle θT to be smaller, and when the transporter angle θ becomes smaller than the initial radius, the steering angle adjusting unit 463 sets the steering angle θT to be larger, so that the traveling of the self-propelled transporter 50 and the slewing of the upper slewing body 11 can be stably linked while maintaining the transporter angle θ at around 90 degrees.

Further, in the present embodiment, the steering angle adjusting unit 463 sets the steering angle θT smaller as the transporter radius R detected by the transporter radius detecting unit 48 is larger than the initial radius, and sets the steering angle θT larger as the transporter radius R detected by the transporter radius detecting unit 48 is smaller than the initial radius.

According to the present configuration, even if the transporter radius R suddenly increases due to the incline of the ground or the unevenness of the road surface while the self-propelled transporter 50 is traveling, the steering angle adjusting unit 463 sets the steering angle θT to be smaller, so that the traveling of the self-propelled transporter 50 and the slewing of the upper slewing body 11 can be stably linked. Further, even if the transporter radius R suddenly decreases due to the incline of the ground or the unevenness of the road surface while the self-propelled transporter 50 is traveling, the steering angle adjusting unit 463 sets the steering angle θT to be larger, so that the traveling of the self-propelled transporter 50 and the slewing of the upper slewing body 11 can be stably linked while maintaining the transporter angle θ at around 90 degrees.

Furthermore, in the present embodiment, the crane 10 includes the transporter operation unit 460 disposed in the cab 10K which allows the operator to ride and given an operation from the operator for traveling the self-propelled transporter 50, and the drive control unit 462 (command signal input unit). The drive control unit 462, regardless of the steering angle θT set by the steering angle adjusting unit 463, inputs the command signals to the wheel drive device 57, the first steering device 52A and the second steering device 52B of the self-propelled transporter 50 in order to roll and steer the plurality of wheels 531 in accordance with the aforementioned operation given to the transporter operation unit 460.

According to such a configuration, an operator can control the traveling of the self-propelled transporter 50 by operating the transporter operation unit 460 in the cab 10K. Therefore, it is possible to operate the self-propelled transporter 50 from the cab 10K of the crane 10 when an operation other than the transporter slewing operation is performed or when the self-propelled transporter 50 is disposed at a predetermined initial position for preparation of the transporter slewing operation.

As described above, the crane 10 according to the embodiment of the present invention has been described. Note that the present invention is not limited to these forms. The present invention may take variations such as, for example, the following.

(1) In the above embodiment, as an example of a crane according to the present invention, the crane 10 shown in FIG. 1 has been described as an example, but the present invention is not limited thereto. The crane may have no one of the HL mast 14 and the box mast 15, or may be one in which a jib (not shown) is disposed at the distal end of the boom 13, or may be made of other structures.

(2) The above embodiment has been described with reference to a connecting beam 60 including a beam body 61 and a slider 62 as a connecting body according to the present invention, the connecting body may have a telescopic structure known to be stretchable. In this case, the base end portion of the telescopic structure is connected to the rear end portion of the upper slewing body 11, the distal end portion of the telescopic structure may be rotatably connected to the self-propelled transporter 50 (pallet 51P) about the rotation center axis DL.

(3) In the above embodiment, an aspect has been described in which the steering angle θT of the plurality of wheels 531 is the same, however, the steering angle θT of each wheel 531 may be set independently of each other.

(4) In the above embodiment, the weight guy-link 36 has been described in a manner that connects the distal end portion of the HL mast 14 and the guy-link connecting portion 55 of the self-propelled transporter 50, but the present invention is not limited thereto. Instead of the weight guy-link 36, cables, ropes, wires, etc. may be used as the guy-line for the weight.

(5) Further, the above embodiment has been described in which the connecting beam 60 is connected to the side plates 11A of the upper slewing body 11, however, the connected portion of the upper slewing body 11 side is not limited to the side plates 11A, a bottom plate or a rear plate of the upper slewing body 11 may be connected via a bracket. Further, the relationship in the slewing operation of the upper slewing body 11 and the self-propelled transporter 50 may be a mode in which the self-propelled transporter 50 pulls the upper slewing body 11 in the slewing direction while the upper slewing body 11 being rotated by the traveling force of the self-propelled transporter 50, or a mode in which the self-propelled transporter 50 travels around the upper slewing body 11 while the upper slewing body 11 being rotated by the slewing motor.

(6) Further, in the above embodiment, as shown in Table 1, the steering angle adjusting unit 463 sets the respective steering angles θT of the plurality of wheels 531 in accordance with the transporter radius R detected by the transporter radius detecting unit 48 and the transporter angle θ detected by the transporter angle detecting unit 47 so that the transporter angle θ approaches 90 degrees, however, the steering angle adjusting unit 463 may set the respective steering angles θT of the plurality of wheels 531 based only on the transporter angle θ detected by the transporter angle detecting unit 47 so that the transporter angle θ approaches 90 degrees. In this case, information in which each steering angle θT is set in accordance with the change in the transporter radius R in Table 1 becomes unnecessary. Further, conventionally, in the case where the self-propelled transporter 50 and the upper slewing body 11 are rigidly linked, a large load is applied to the connecting body during the transporter slewing operation, whereas the present modified embodiment is based on the philosophy that the traveling of the self-propelled transporter 50 and the slewing of the upper slewing body 11 are linked by maintaining the relative posture between the self-propelled transporter 50 and the upper slewing body 11 without positively maintaining the transporter radius R at the same distance. When the transporter radius R is slightly deviated from the initial radius at the destination of the self-propelled transporter 50, the steering direction of the plurality of wheels 531 of the self-propelled transporter 50 is set in the radial direction of the slewing of the upper slewing body 11, so that the relative position of the self-propelled transporter 50 with respect to the upper slewing body 11 may be adjusted while the slider 62 is moved relative to the beam body 61.

Incidentally, as described above, by setting the respective steering angle θT of the plurality of wheels 531 so that the transporter angle θ approaches 90 degrees, a large load applied to the connecting beam 60 and the upper slewing body 11 during slewing is suppressed. The setting of the steering angle θT, that is, the change of the steering angle, can cause a change immediately in the slewing direction, while it is not immediately affected in the radial direction in terms of the lifting capacity and stability, so that it is sufficiently possible to realize a stable slewing operation to the destination.

On the other hand, the steering angle adjusting unit 463 may set the respective steering angle θT of the plurality of wheels 531 positively in accordance with the transporter radius R detected by the transporter radius detecting unit 48 and the transporter angle θ detected by the transporter angle detecting unit 47 so that the transporter angle θ approaches 90 degrees and the transporter radius R approaches the initial radius. In this case, even if the direction of each wheel 531 of the self-propelled transporter 50 may change due to the inclination of the ground or the unevenness of the road surface, the traveling of the self-propelled transporter 50 and the slewing of the upper slewing body 11 can be stably linked while the transporter radius R is brought close to the initial radius while maintaining the transporter angle θ to the vicinity of 90 degrees. Therefore, as compared with the case of setting the respective steering angles θT of the plurality of wheels 531 for the purpose of only maintaining the transporter angle θ at 90 degrees, the transporter can reach the destination at a position closer to the circumference of the initial radius around the slewing center axis CL.

What is provided by the present invention is a crane used with a self-propelled transporter. The self-propelled transporter includes a loading platform, a plurality of wheels disposed below the loading platform and capable of rolling on the traveling surface, a wheel drive unit capable of respectively rolling the plurality of wheels by receiving a predetermined traveling command signal, and a wheel steering unit capable of steering the plurality of wheels around the steering center axis extending in the vertical direction respectively by receiving a predetermined steering command signal.

The crane includes a lower body, an upper slewing body, a derricking body, a mast, a counterweight, a guy-line, a connecting body, a transporter angle detecting unit, a traveling signal input unit, a steering angle setting unit, and a traveling signal input unit.

The upper slewing body is mounted on the lower body to be pivotable about a slewing center axis extending in the vertical direction.

The derricking body is rotatably attached to the upper slewing body in a derricking direction.

The mast is rotatably mounted on the upper slewing body in a derricking direction at the rear of the derricking body in the front-rear direction of the upper slewing body, and supports the derricking body from the rear.

The counterweight is supported on the loading platform of the self-propelled transporter at the rear of the upper slewing body in the front-rear direction.

The guy-line connects the counterweight and the distal end of the mast to each other.

The connecting body connects the rear end portion of the upper slewing body and the transporter to each other in the front-rear direction. The connecting body includes a slewing body connecting portion and a transporter connecting portion. The slewing body connecting portion is connected to the rear end portion of the upper slewing body in the front-rear direction. The transporter connecting portion is coupled to the transporter so as to be rotatable about a rotation center axis extending in the vertical direction, and is movable relatively in the front-rear direction with respect to the slewing body connecting portion in accordance with the travel of the transporter in a direction including the front-rear direction.

The transporter angle detecting unit is capable of detecting the transporter angle. The transporter angle is, in a plan view, an angle formed by a line segment connecting the slewing center axis and the rotation center axis and a line segment extending from the rotation center axis in the straight driving direction of the transporter.

The traveling signal input unit inputs the traveling command signal to the wheel drive unit in the transporter slewing operation. The transporter slewing operation is an operation in which the transporter travels on the traveling surface in a slewing direction around the slewing center axis in a state where the upper slewing body and the transporter are connected to each other by the connecting body and the rotation center axis in the plan view is disposed on the circumference of a predetermined initial radius around the slewing center axis.

The steering angle setting unit sets a steering angle of the plurality of wheels with respect to the straight driving direction to a preset initial steering angle respectively at the start of the transporter slewing operation, and sets the steering angle of the plurality of wheels in accordance with at least the transporter angle detected by the transporter angle detecting unit so that the transporter angle approaches 90 degrees during the transporter slewing operation. The initial steering angle is an angle set in accordance with the initial radius so that each of the plurality of wheels faces the inside in the radial direction.

The steering signal input unit inputs the steering command signal corresponding to the steering angle set by the steering angle setting unit.

According to the present configuration, when performing the transporter slewing operation in which the upper slewing body is rotated by the traveling of the transporter, or in which the transporter travels so as to follow the slewing operation of the upper slewing body, it is possible to perform the transporter slewing operation by adjusting the steering angle of each wheel so as to maintain the transporter angle at 90 degrees while the transporter is allowed to move relative to the upper slewing body, without rigidly connecting the transporter and the upper slewing body. In particular, since the transporter is relatively movable in the front-rear direction with respect to the upper slewing body and is relatively rotatable about the rotation central axis via the connecting body, even if the direction of each wheel of the transporter is changed by such incline of the ground and unevenness of the road surface, a large load on the connecting body and the upper slewing body is suppressed. Further, since the steering angle setting unit can adjust each of the steering angles of the plurality of wheels so as to maintain the transporter angle in the vicinity of 90 degrees, the upper slewing body can be efficiently rotated by the traveling of the transporter along the slewing direction when the upper slewing body is rotated by the traveling of the transporter, and the traveling of the transporter can be prevented from hindering the turning of the upper slewing body when the transporter travels so as to follow the slewing operation of the upper slewing body. Therefore, it is not necessary for the operator to adjust the steering angle of the wheels of the transporter each time the traveling direction of the transporter is shifted, and it is possible to stably link the traveling of the transporter and the slewing of the upper slewing body.

In the above-described configuration, it is desirable that the steering angle setting unit sets the steering angle larger than the initial steering angle when the transporter angle detected by the transporter angle detecting unit is larger than 90 degrees, and sets the steering angle smaller than the initial steering angle when the transporter angle detected by the transporter angle detecting unit is smaller than 90 degrees.

According to the present configuration, since the transporter travels radially outward when the transporter angle becomes larger than 90 degrees, the steering angle setting unit sets the steering angle larger than the initial steering angle whereby the transporter angle can be made close to 90 degrees. On the other hand, since the transporter travels radially inward when the transporter angle becomes smaller than 90 degrees, the steering angle setting unit sets the steering angle smaller than the initial steering angle whereby the transporter angle can be made close to 90 degrees.

In the above configuration, it is desirable that the steering angle setting unit sets the steering angle larger as the transporter angle detected by the transporter angle detecting unit is greater than 90 degrees, and sets the steering angle smaller as the transporter angle detected by the transporter angle detecting unit is smaller than 90 degrees.

According to the present configuration, since the steering angle setting unit can adjust the size of the steering angle according to the size of the transporter angle, the transporter angle can be brought close to 90 degrees at an early stage even when the transporter angle is shifted.

In the above configuration, it is desirable that the crane further includes a transporter radius detecting unit capable of detecting the transporter radius, which is a radius of the transporter around the slewing center axis, and it is desirable that the steering angle setting unit sets the respective steering angles of the plurality of wheels in accordance with the transporter angle detected by the transporter angle detecting unit and the transporter radius detected by the transporter radius detecting unit so that the transporter angle approaches 90 degrees.

According to this configuration, even if the direction of each wheel of the transporter may change due to the inclination of the ground or unevenness of the road surface, the traveling of the transporter and the rotation of the upper slewing body can be linked while maintaining the transporter angle around 90 degrees. Therefore, at a position close to the circumference of the initial radius around the slewing center axis, the transporter can reach the destination.

In the above-described configuration, it is desirable that the steering angle setting unit sets the steering angle to be smaller than the case where the transporter radius is the initial radius when the transporter radius detected by the transporter radius detecting unit is larger than the initial radius, and sets the steering angle to be larger than the case where the transporter radius is the initial radius when the transporter radius detected by the transporter radius detecting unit is smaller than the initial radius.

According to the present configuration, when the transporter radius becomes larger than the initial radius, the steering angle setting unit sets the steering angle to be smaller, and when the transporter radius becomes smaller than the initial radius, the steering angle setting unit sets the steering angle to be larger, so that the traveling of the transporter and the slewing of the upper slewing body can be linked.

In the above-described configuration, it is desirable that the steering angle setting unit sets the steering angle smaller as the transporter radius detected by the transporter radius detecting unit is larger than the initial radius, and sets the steering angle larger as the transporter radius detected by the transporter radius detecting unit is smaller than the initial radius.

According to the present configuration, since the steering angle setting unit can set the size of the steering angle according to the size of the transporter radius, the traveling of the transporter and the slewing of the upper slewing body can be further stably linked.

In the above configuration, it is desirable that the crane further includes a transporter operating unit arranged in a cab allowing the operator to ride and configured to receive operation from the operator for traveling the transporter, and a command signal input unit for inputting the traveling command signal to the wheel drive unit and the steering command signal to the wheel steering unit in response to the operation given to the transporter operating unit regardless of the steering angle set by the steering angle setting unit.

According to the present configuration, it is possible for the operator to control the traveling of the transporter by operating the transporter operating unit in the cab. Therefore, it is possible to operate the transporter from the cab of the crane, such as when performing operations other than the transporter slewing operation or when placing the transporter at a predetermined initial position for preparation of the transporter slewing operation.

According to the present invention, a crane capable of stably traveling the transporter in cooperation with the rotation of the upper slewing body while suppressing a large load applied to the connecting body connecting the counterweight and the upper slewing body to each other.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A crane used with a self-propelled transporter, the self-propelled transporter includes a loading platform, a plurality of wheels disposed below the loading platform and capable of rolling on a traveling surface, a wheel drive unit capable of rolling the plurality of wheels respectively by a predetermined traveling command signal given, a wheel steering unit capable of steering the plurality of wheels around a steering center axis extending in the vertical direction respectively by a predetermined steering command signal given, the crane comprising:

a lower body;

an upper slewing body mounted on the lower body pivotally about a slewing center axis extending in the vertical direction;

a derricking body rotatably mounted on the upper slewing body in a derricking direction;

a mast rotatably mounted in a derricking direction on the upper slewing body at the rear of the derricking body in the front-rear direction of the upper slewing body, and configured to support the derricking body from the rear;

a counterweight supported on the loading platform of the self-propelled transporter at the rear of the upper slewing body in the front-rear direction;

a guy-line connecting the counterweight and the distal end of the mast;

a connecting body configured to connect the rear end portion of the upper slewing body and the transporter to each other in the front-rear direction and includes a slewing body connecting portion connected to the rear end portion of the upper slewing body in the front-rear direction and a transporter connecting portion connected to the transporter so as to be rotatable about a rotation center axis extending in the vertical direction and relatively movable in the front-rear direction with respect to the slewing body connecting portion in accordance with the movement of the self-propelled transporter in a direction including the front-rear direction;

a transporter angle detecting unit capable of detecting a transporter angle that is an angle formed by a line segment connecting the slewing center axis and the rotation center axis and a line segment extending from the rotation center axis in a straight traveling direction of the transporter in a plan view;

a traveling signal input unit configured to input the traveling command signal to the wheel drive unit during the transporter slewing operation that is an operation in which the transporter travels on the traveling surface in a slewing direction around the slewing center axis in a state in which the upper slewing body and the transporter is connected to each other by the connecting body and the rotation center axis in a plan view is disposed on a circumference of a predetermined initial radius around the slewing center axis;

a steering angle setting unit configured to set the steering angle of the plurality of wheels at the start of the transporter slewing operation to the initial steering angle preset in accordance with the initial radius so that each of the plurality of wheels faces the inside in the radial direction, and set the steering angle during the transporter slewing operation in accordance with at least the transporter angle detected by the transporter angle detecting unit so that the transporter angle approaches 90 degrees; and a steering signal input unit configured to input the steering command signal to the wheel steering unit corresponding to the steering angle set by the steering angle setting unit.

2. The crane according to claim 1, wherein the steering angle setting unit sets the steering angle larger than the initial steering angle when the transporter angle detected by the transporter angle detecting unit is larger than 90 degrees, and sets the steering angle smaller than the initial steering angle when the transporter angle detected by the transporter angle detecting unit is smaller than 90 degrees.

3. The crane according to claim 2, wherein the steering angle setting unit sets the steering angle larger as the transporter angle detected by the transporter angle detecting unit is larger than 90 degrees, and sets the steering angle smaller as the transporter angle detected by the transporter angle detecting unit is smaller than 90 degrees.

4. The crane according to claim 1, further comprising a transporter radius detecting unit capable of detecting a transporter radius which is a radius of the transporter about the slewing center axis, wherein the steering angle setting unit sets the respective steering angles of the plurality of wheels in accordance with the transporter angle detected by the transporter angle detecting unit and the transporter radius detected by the transporter radius detecting unit so that the transporter angle approaches 90 degrees.

5. The crane according to claim 4, wherein the steering angle setting unit sets the steering angle to be smaller than the case where the transporter radius is the initial radius when the transporter radius detected by the transporter radius detecting unit is larger than the initial radius, and sets the steering angle to be larger than the case where the transporter radius is the initial radius when the transporter radius detected by the transporter radius detecting unit is smaller than the initial radius.

6. The crane according to claim 5, wherein the steering angle setting unit sets the steering angle smaller as the transporter radius detected by the transporter radius detecting unit is larger than the initial radius, and sets the steering angle larger as the transporter radius detected by the transporter radius detecting unit is smaller than the initial radius.

7. The crane according to claim 1, further comprising:

a transporter operating unit disposed in a cab allowing an operator to ride on and given operation from the operator for traveling the transporter; and a command signal input unit configured to input the traveling command signal to the wheel drive unit and the steering command signal to the wheel steering unit in response to the operation given to the transporter operating unit regardless of the steering angle set by the steering angle setting unit.

* * * * *